US010952518B1

(12) United States Patent
Kosloff et al.

(10) Patent No.: US 10,952,518 B1
(45) Date of Patent: Mar. 23, 2021

(54) SUBSTANCE DISPENSING HANDLE AND CONTAINER ASSEMBLIES, SUBSTANCE DISPENSING HANDLES, AND PERSONAL CARE DEVICES

(71) Applicant: ICI Enterprises, LLC, Scottsdale, AZ (US)

(72) Inventors: Sandy J. Kosloff, Scottsdale, AZ (US); Jason A. Kosloff, Scottsdale, AZ (US)

( * ) Notice: Subject to any disclaimer, the term of this patent is extended or adjusted under 35 U.S.C. 154(b) by 0 days.

(21) Appl. No.: 17/084,342

(22) Filed: Oct. 29, 2020

Related U.S. Application Data

(60) Provisional application No. 62/927,558, filed on Oct. 29, 2019.

(51) Int. Cl.

| | |
|---|---|
| ***A45D 40/20*** | (2006.01) |
| ***A45D 34/04*** | (2006.01) |
| *A46B 9/02* | (2006.01) |
| *A46B 11/00* | (2006.01) |
| *B26B 21/52* | (2006.01) |
| *B26B 21/44* | (2006.01) |

(52) U.S. Cl.
CPC ..... *A45D 34/04* (2013.01); *A45D 2200/1018* (2013.01); *A46B 9/023* (2013.01); *A46B 11/0041* (2013.01); *A46B 11/0062* (2013.01); *A46B 2200/104* (2013.01); *B26B 21/446* (2013.01); *B26B 21/521* (2013.01)

(58) Field of Classification Search
CPC ... A45D 34/04; A45D 34/042; A61M 35/003; A61M 35/006
USPC ..... 401/88, 131, 133; 132/317
See application file for complete search history.

(56) References Cited

U.S. PATENT DOCUMENTS

| | | | |
|---|---|---|---|
| 1,878,475 | A | 9/1932 | Driest |
| 4,129,942 | A | 12/1978 | Denizman |
| 4,635,361 | A | 1/1987 | DeMars |
| D291,013 | S | 7/1987 | Plummer |
| 4,753,006 | A | 6/1988 | Howe |
| 7,025,521 | B2 * | 4/2006 | Tsaur |
| 7,818,883 | B2 | 10/2010 | Lax |
| 8,882,380 | B2 * | 11/2014 | Jimenez |
| 10,800,058 | B2 * | 10/2020 | Eagleton |
| 2017/0001320 | A1 | 1/2017 | Hodgson et al. |
| 2018/0200899 | A1 | 7/2018 | Eagleton et al. |

* cited by examiner

*Primary Examiner* — Jennifer C Chiang
(74) *Attorney, Agent, or Firm* — Parsons & Goltry, PLLC; Michael W. Goltry; Robert A. Parsons

(57) ABSTRACT

A personal care device includes a handle including a head supporting a personal care implement, a cradle longitudinally extending from the head to a proximal extremity open to the cradle, an elongate opening open to the cradle and extending longitudinally between the head and the proximal extremity and defined by mutually respective longitudinal edges, and a container extending longitudinally through the cradle. The container is deformable and a longitudinal part of the container extends laterally outward from the cradle through the elongate opening beyond the longitudinal edges. The container includes a dispensing opening proximate to the proximal extremity that is normally closed by a closure. In another embodiment, the container is coupled in fluid communication to the personal care implement.

28 Claims, 40 Drawing Sheets

38
100
208
350
200
292
312
290A
38

370
375
124
100
122
A
250
208
353
352
209
207
356
350
200
202

100
375
200
124
370
A
122
208
250
209
352
353
202
356
201
354
206
350
300
302
360
364
292
362
312
290A 43
404
385
384
380
380
392
382
390
396
398
386
43

404
400
385
384
382
392
402
406

D
380
392
382
402
406
390
396
386
398

SUBSTANCE DISPENSING HANDLE AND CONTAINER ASSEMBLIES, SUBSTANCE DISPENSING HANDLES, AND PERSONAL CARE DEVICES

CROSS-REFERENCE TO RELATED APPLICATION

This application claims the benefit of U.S. Provisional Patent Application No. 62/927,558, filed 29 Oct. 2019, incorporated herein by reference in its entirety.

FIELD OF THE INVENTION

The present invention relates generally to substance dispensing handle and container assemblies, substance dispensing handles, and personal care implements, such as shaving razors primarily used in the removal of unwanted body hair through the act of wet shaving, applicators for applying cosmetics, cleansers, or other personal care composition, and toothbrushes useful for brushing teeth with a toothpaste or gel dentifrice.

BACKGROUND OF THE INVENTION

Various personal care products include implements and specific preparations designed to be used or applied by those implements. Examples of personal care implements and preparations include razors used in removing unwanted body hair through the act of wet shaving in conjunction with a corresponding shaving-related preparation, applicators used in the application of topical preparations, cosmetic preparations, cleaning preparations, and the like.

One type of personal care implement is the razor. A standard razor includes a head of a handle and a bladed member of the head. The handle is taken up by hand by the shaver for shaving. To effectuate shaving, the user typically applies a shaving cosmetic preparation, such as shaving cream, a shaving gel, a shaving soap, or other lather-forming preparation to the face or body portion to be shaved, which is wiped away during shaving. Other cosmetic preparations commonly used in conjunction with shaving include pre-shave lotions/balms intended to treat the hair for improved shaving action and aftershave preparations used upon completing the shaving operation, such as alcohol-based liquids, lotions, balms, and pastes. Other personal care implements and related preparations include, for example, applicator or cleansing pads used to apply cleanser and other topical preparations, toothbrushes used to brush teeth in the presence of a chosen toothpaste or gel dentifrice.

The above-described personal care implements and the personal care compositions or preparations used therewith are conventionally separate items typically stored in proximity with one another in a suitable storage area, such as a medicine cabinet, bathroom drawer, or the like. Because they are separate from one another, they can often become lost or misplaced, especially while traveling. While skilled artisans have developed personal care implements that incorporate associated personal care preparations, they are structurally complex, difficult and cumbersome to use, expensive, and contain an excessive number of easily breakable parts. Given at least these deficiencies, the need for continued improvement in the art is evident.

SUMMARY OF THE INVENTION

According to the principle of the invention, a handle and container assembly includes a handle including a head, a cradle longitudinally extending from the head to a proximal extremity open to the cradle, an elongate opening open to the cradle and extending longitudinally between the head and the proximal extremity and defined by mutually respective longitudinal edges, a container longitudinally extending through the cradle from proximate to the head to a dispensing opening proximate to the proximal extremity and normally closed by a closure, and the container is deformable and a longitudinal part of the container extends laterally outward from the cradle through the elongate opening beyond the longitudinal edges. The container is resiliently deformable enabling the container to spring back, rebound, or otherwise return to an original form, an un-squeezed or un-collapsed form, after being deformed or collapsed by being squeezed. The elongate opening has a length from the head to the proximal extremity, and the longitudinally part of the container extends longitudinally through the length of the elongate opening from the head to the proximal extremity. The closure is movable from a first position, wherein the dispensing opening normally closed, to a second position, wherein the dispensing opening is open, and the closure extends longitudinally outwardly from the proximal extremity to enable movement of the closure between the first position and the second position without interference from the handle. The container is received slidably in the cradle through the proximal extremity. A retention assembly serves to releasably retain the container to the cradle and includes retention elements of the container received slidably by corresponding complemental retention elements of the cradle, wherein each retention element is one of a rib and a groove and each complement retention element is the other of the rib and the groove. The ribs and the grooves concurrently extend longitudinally in a direction from the head to the proximal extremity. An outer end of the container opposite to the dispensing opening is juxtaposed with the head, and the longitudinal part extends between the outer end of the container and the proximal extremity. The outer end of the container is in direct contact against the head. A personal care implement is carried by the head. The personal care implement is connected releasably to the head. The head includes an inlet in fluid communication with the container and an outlet in fluid communication with the inlet. The inlet includes a nipple extending into the container from the head. The outlet is open to the personal care implement. The personal care implement is connected releasably to the head by an engagement element of the head connected releasably to a complemental engagement element of the personal care implement, and the outlet is open to the personal care implement from the engagement element.

According to the principle of the invention, a handle and container assembly includes a handle including a head, a cradle longitudinally extending from the head to a proximal extremity open to the cradle, an elongate opening open to the cradle and extending longitudinally between the head and the proximal extremity and defined by mutually respective longitudinal edges, and a container longitudinally extending through the cradle. The container is deformable and a longitudinal part of the container extends laterally outward from the cradle through the elongate opening beyond the longitudinal edges. The head includes an inlet in fluid communication with the container and an outlet in fluid communication with the inlet. The container is resiliently deformable enabling the container to spring back, rebound, or otherwise return to an original form, an un-squeezed or un-collapsed form, after being deformed or collapsed by being squeezed. The inlet includes a nipple extending into the container from the head. The container includes an outer end in direct contact against the head, the nipple extends into the container through the outer end, and the longitudinal part extends between the outer end of the container and the proximal extremity. The container additionally includes a dispensing opening proximate to the proximal extremity and normally closed by a closure. The container is received slidably in the cradle through the proximal extremity. A retention assembly serves to releasably retain the container to the cradle and includes retention elements of the container received slidably by corresponding complemental retention elements of the cradle, wherein each retention element is one of a rib and a groove and each complement retention element is the other of the rib and the groove. The ribs and the grooves concurrently extend longitudinally in a direction from the head to the proximal extremity. A personal care implement is carried by the head, and the outlet is open to the personal care implement. The personal care implement is connected releasably to the head by an engagement element of the head connected releasably to a complemental engagement element of the personal care implement, and the outlet is open to the personal care implement from the engagement element.

According to the principle of the invention, a personal care device includes a handle including a head supporting a personal care implement, a cradle extending longitudinally from the head to the proximal extremity open to the cradle, an elongate opening open to the cradle and extending longitudinally between the head and the proximal extremity and defined by mutually respective longitudinal edges, and a container in fluid communication with the personal care implement and longitudinally extending through the cradle. The container is deformable and a longitudinal part of the container extends laterally outward from the cradle through the elongate opening beyond the longitudinal edges. The container is resiliently deformable enabling the container to spring back, rebound, or otherwise return to an original form, an un-squeezed or un-collapsed form, after being deformed or collapsed by being squeezed. The container additionally includes a dispensing opening proximate to the proximal extremity and normally closed by a closure. The container is received slidably in the cradle through the proximal extremity. A retention assembly serves to releasably retain the container to the cradle and includes a retention element of the container received slidably by a corresponding complemental retention element of the cradle, wherein the retention element is one of a tongue and a groove and the complement retention element is the other of the tongue and the groove. The tongue and the groove concurrently extend longitudinally in a direction from the head to the proximal extremity.

According to the principle of the invention, a personal care device includes a head supporting a personal care implement and a handle longitudinally extending from the head to a break-away closure normally closing an outlet to a volume defined by the handle and charged with a personal care composition. The personal care implement is connected releasably to the head.

BRIEF DESCRIPTION OF THE DRAWINGS

Specific objects and advantages of the invention will become readily apparent to those skilled in the art from the following detailed description of illustrative embodiments thereof, taken in conjunction with the drawings in which.

DETAILED DESCRIPTION

Figure 1:
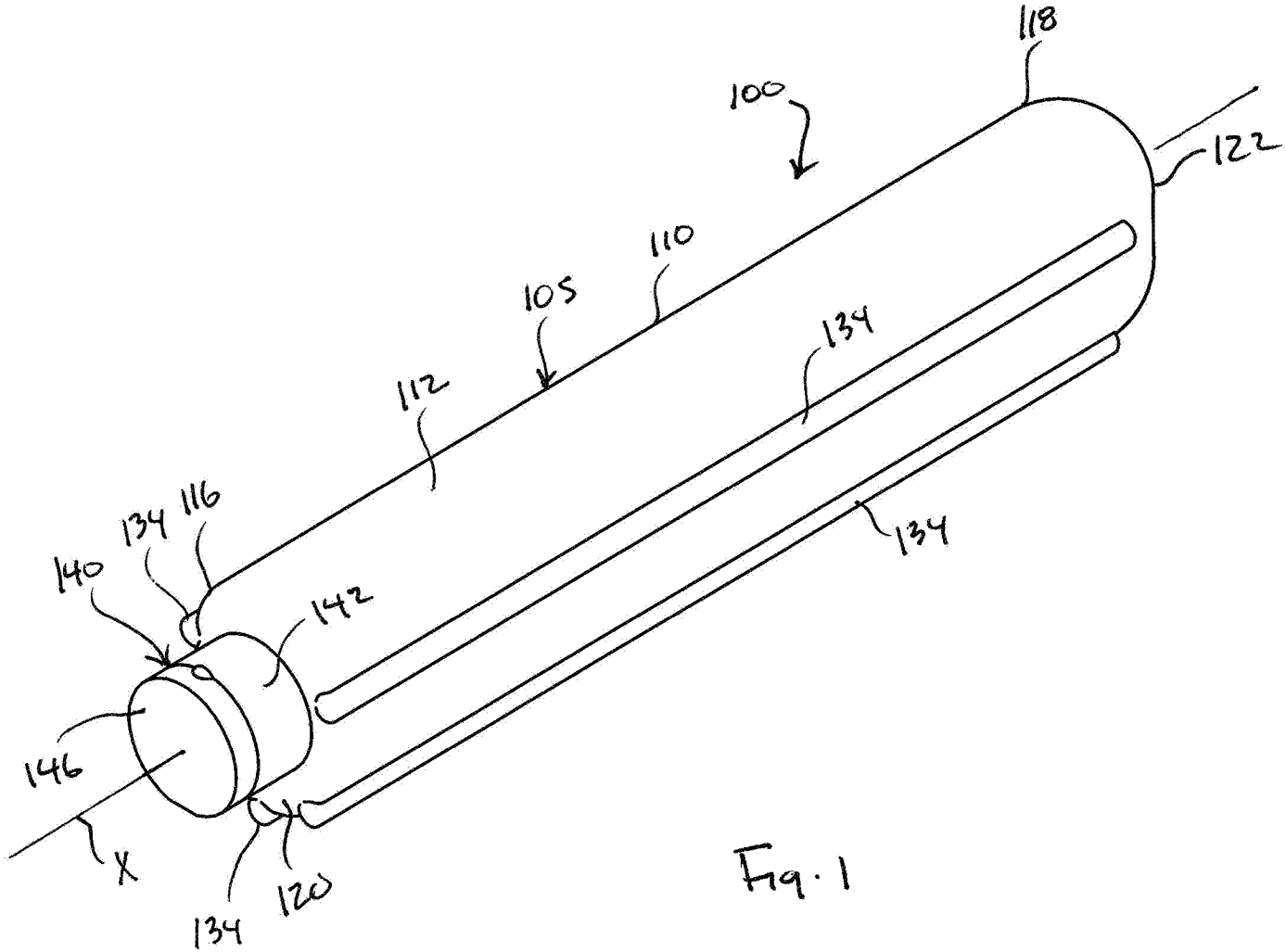
FIG. 1 is a rear perspective view of a substance dispensing container configured with an attached closure shown as it would appear closed.
Figure 2:
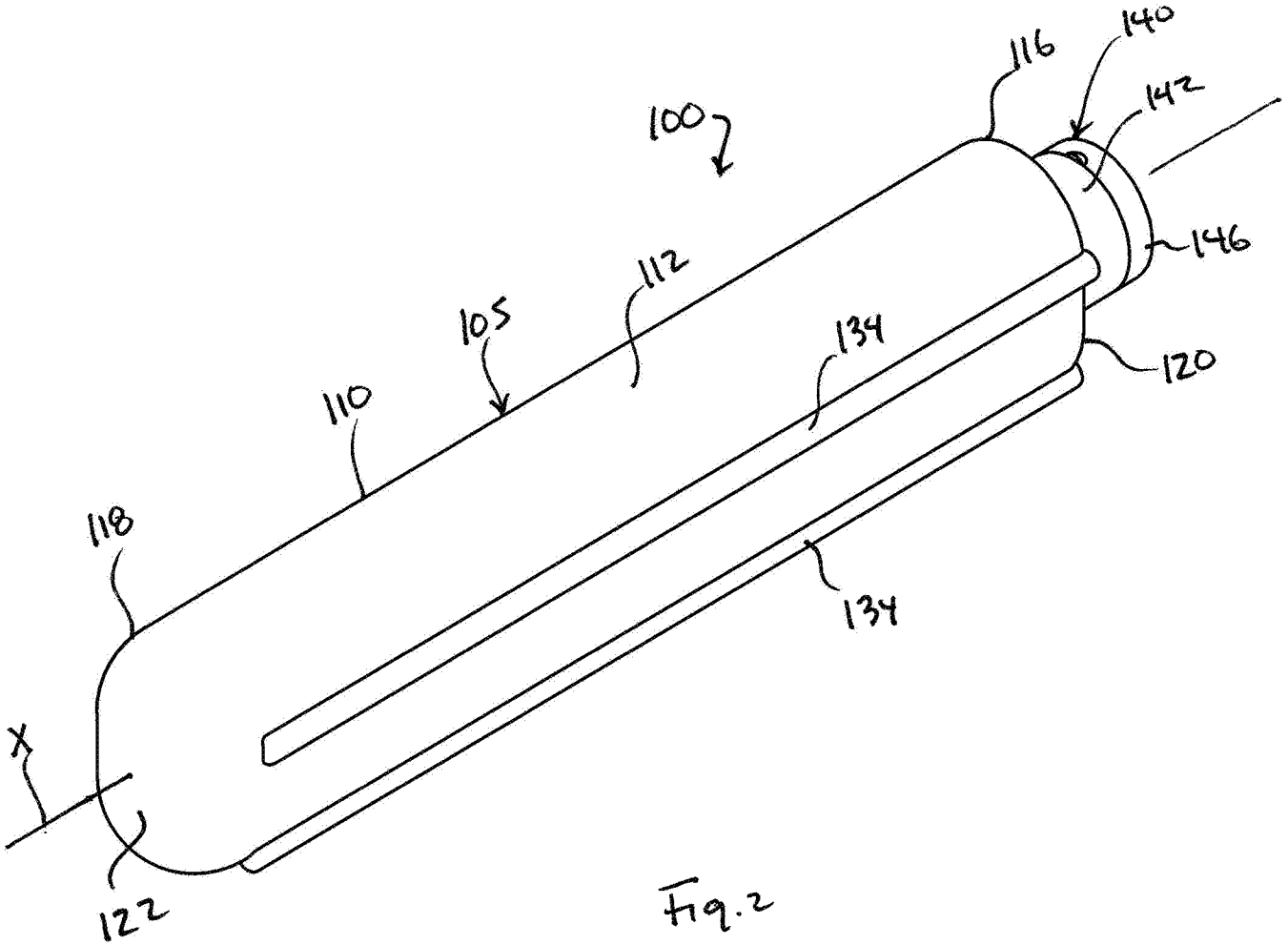
FIG. 2 is a front perspective view of the embodiment of FIG. 1.
Figure 3:
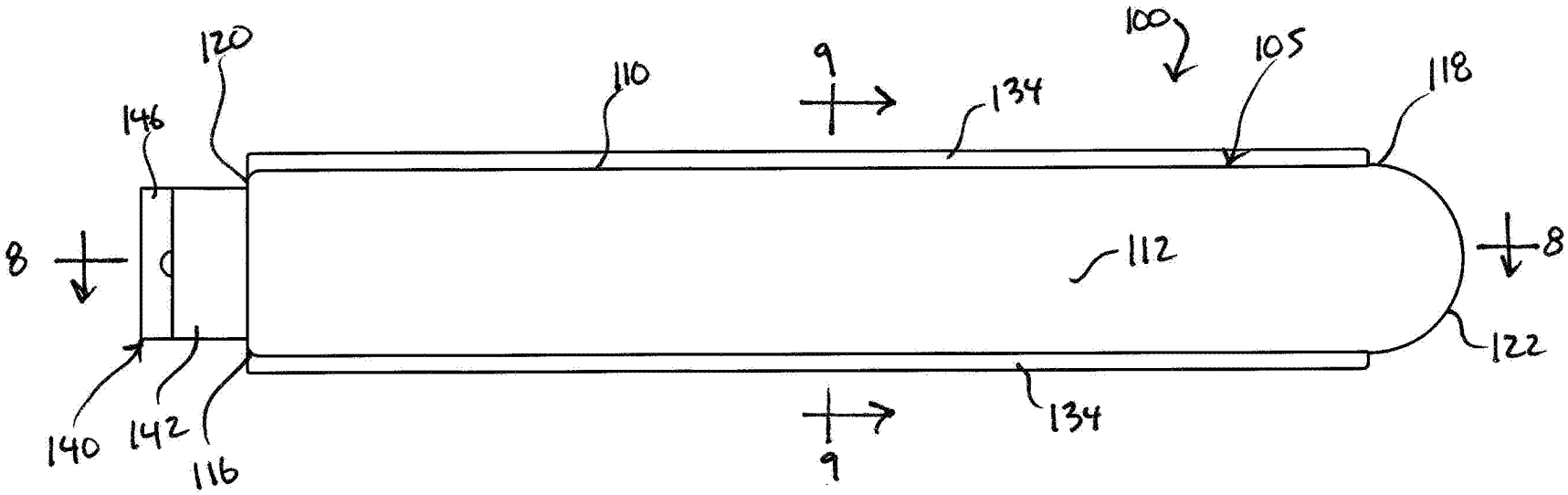
FIG. 3 is a top plan view of the embodiment of FIG. 1.
Figure 4:
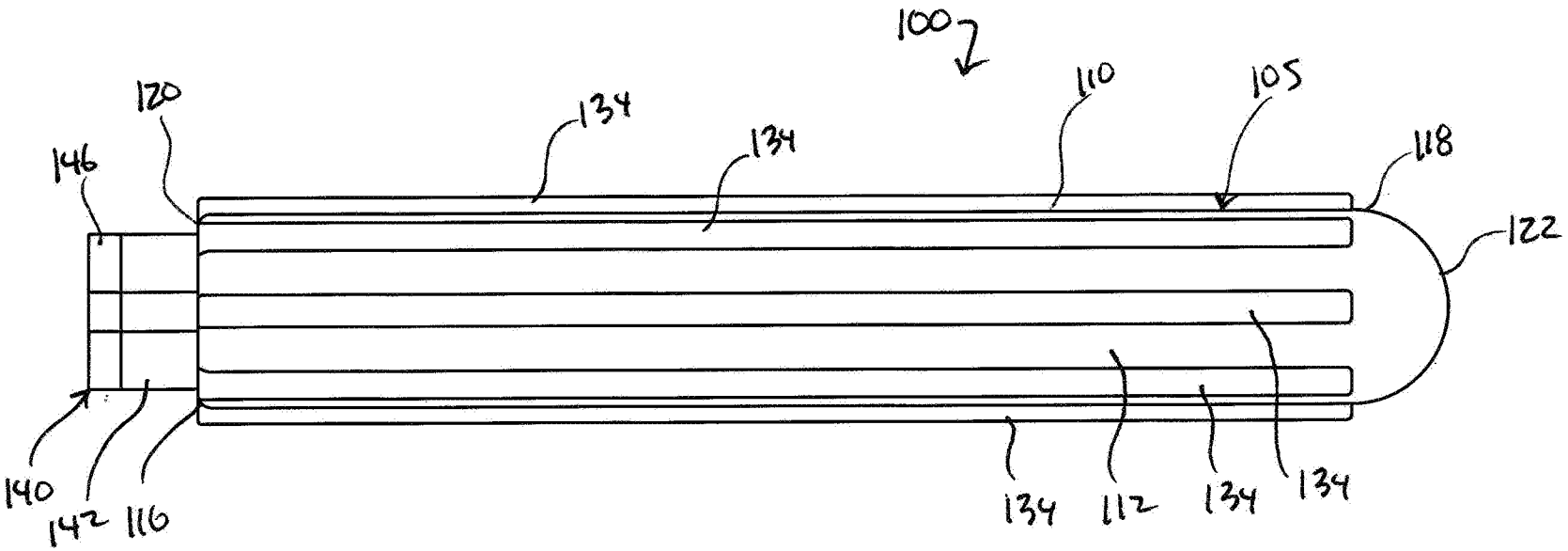
FIG. 4 is a bottom plan view of the embodiment of FIG. 1.
Figure 5:
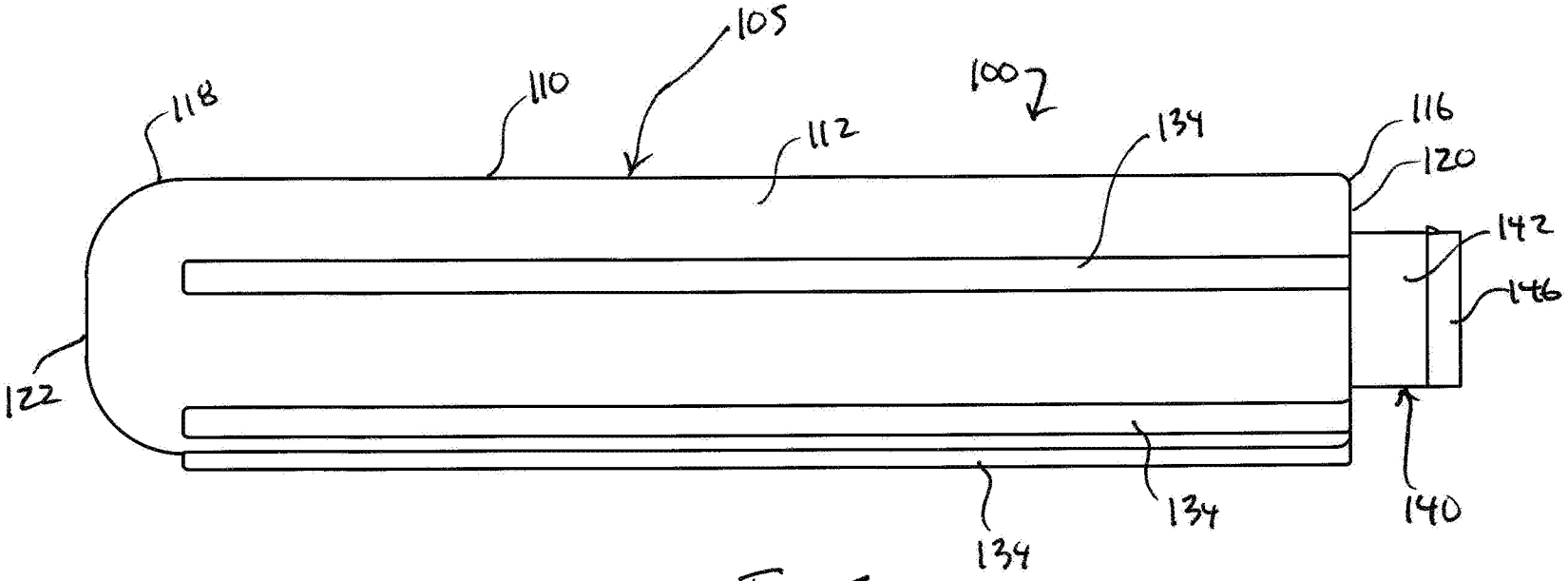
FIG. 5 is a side elevation view of the embodiment of FIG. 1, the opposite side elevation being the same thereof.
Figure 6:
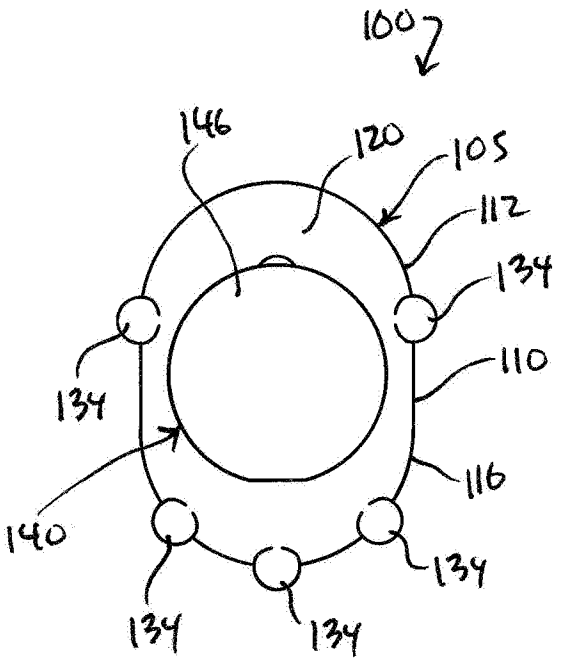
FIG. 6 is a rear elevation view of the embodiment of FIG. 1.
Figure 7:
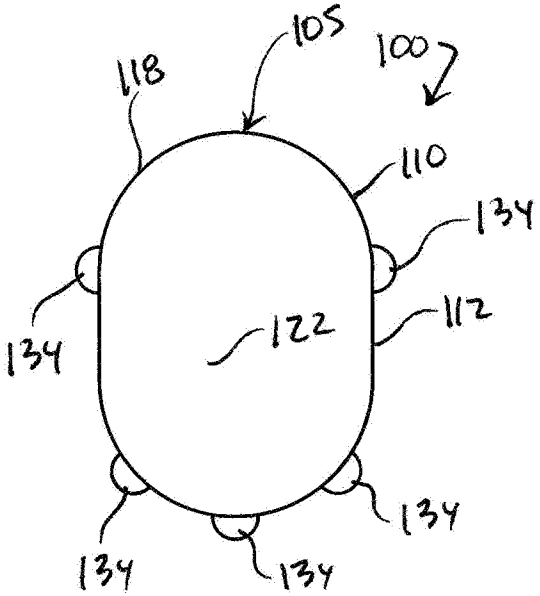
FIG. 7 is a front elevation view of the embodiment of FIG. 1.

Substance dispensing handle and container assemblies, substance dispensing handles, and personal care devices are disclosed, which are simple in structure, inexpensive, portable, and easy to use.

Turning now to the drawings, in which like reference characters indicate corresponding elements throughout the several views, attention is first directed in relevant part to FIGS. 1-12 illustrating a substance-dispensing container 100. Container 100 is an elongate, fluid-impervious bottle configured to hold and dispense a fluid or flowable composition, such as a personal care cosmetic composition according to this disclosure. Container 100 is squeezable and is exemplary of a squeeze bottle, a container of plastic or other inherently flexible and resilient material or combination of materials for dispensing a fluid or flowable composition and that is powered by squeezing container 100 by exerting pressure with the user's hand to compress it. Container 100 is formed integrally and is a resilient, hollow, elongate, integral body 105, in which manual pressure applied thereto is harnessed to compress the contents within it and thereby expel the contents through a suitable dispensing opening. Body 105 is preferably resiliently deformable/collapsible, enabling it to spring back, rebound, or otherwise return to an original form, an un-deformed or un-collapsed form, after being deformed/collapsed by being squeezed.

Body 105 includes an elongate continuous sidewall 110 having outer surface 112, inner surface 114, inner edge 116, and outer edge 118. In this example, continuous sidewall 110 is oblong in shape along its length from inner edge 116 to outer edge 118 as exemplified by its opposed parallel sides that extend between outwardly rounded upper and lower ends and which together concurrently extend from inner edge 116 to outer edge 118. Shoulder 120 defines the inner end of body 105 and is affixed to inner edge 116. Bottom 122 defines the outer end of body 105 and is affixed to outer edge 118. Accordingly, reference character 120 is used interchangeably to denote the shoulder and the inner end of body 105 of container 100, and reference character 122 is used interchangeably to denote the bottom and the outer end of body 105 of container 100. Shoulder 120 and bottom 122 cooperate with inner surface 114 to form fluid-impervious volume 124 in FIGS. 8, 9 and 12 of container 100. Shoulder 120 extends to a hollow, central neck 130 in FIGS. 8 and 12 that defines a dispensing mouth or opening 132. Neck 130 extends outwardly from shoulder 120 to dispensing opening 132 at the outermost end of neck 130 and that is open to volume 124. Chosen contents can be applied to volume 124 through dispensing opening 132 and dispensed from volume 124 through dispensing opening 132. Volume 124 is capable of being charged/filled with chosen contents through dispensing opening 132. Container 100 body 105 is longitudinally straight from neck 130 to bottom 122, has a length from dispensing opening 132 to bottom 122, and is arranged about longitudinal axis X that extends centrally through body 105 from dispensing opening 132 to bottom 122.

Figure 9:
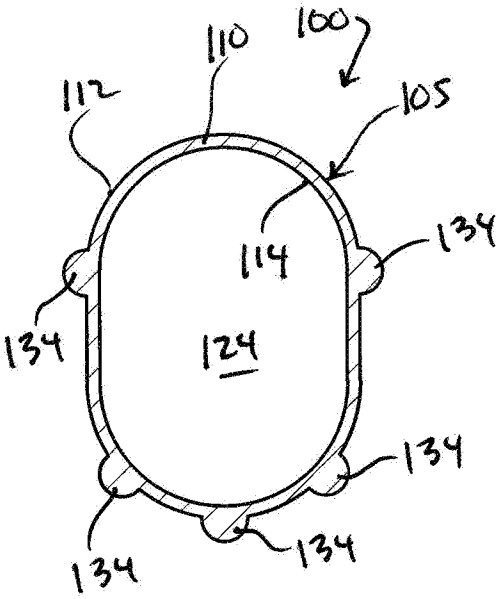
FIG. 9 is a section view taken along line 9-9 of FIG. 3.

Outer surface 112 is configured with protruding ribs 134. Ribs 134 affixed to and protruding outwardly from outer surface 112 are circumferentially spaced apart, parallel to each other and to longitudinal axis X, longitudinally extend along the length of continuous sidewall 110 between shoulder 120 and bottom 122, and are identical and coextensive. Each rib 134 is longitudinally straight and unbroken from end-to-end, one end being proximate to shoulder 120 and the other end being proximate to bottom 122. Body 105 has five ribs 134 in this example, two on either side of continuous sidewall 110 between its upper and lower rounded ends and three along its rounded lower end. Body 105 can include less or more ribs 134 in alternate embodiments consistent with the teachings of this specification. The cross-sectional shape of container 100 illustrated in FIG. 9 is the same or otherwise uniform between shoulder 120 and bottom 122.

Figure 8:
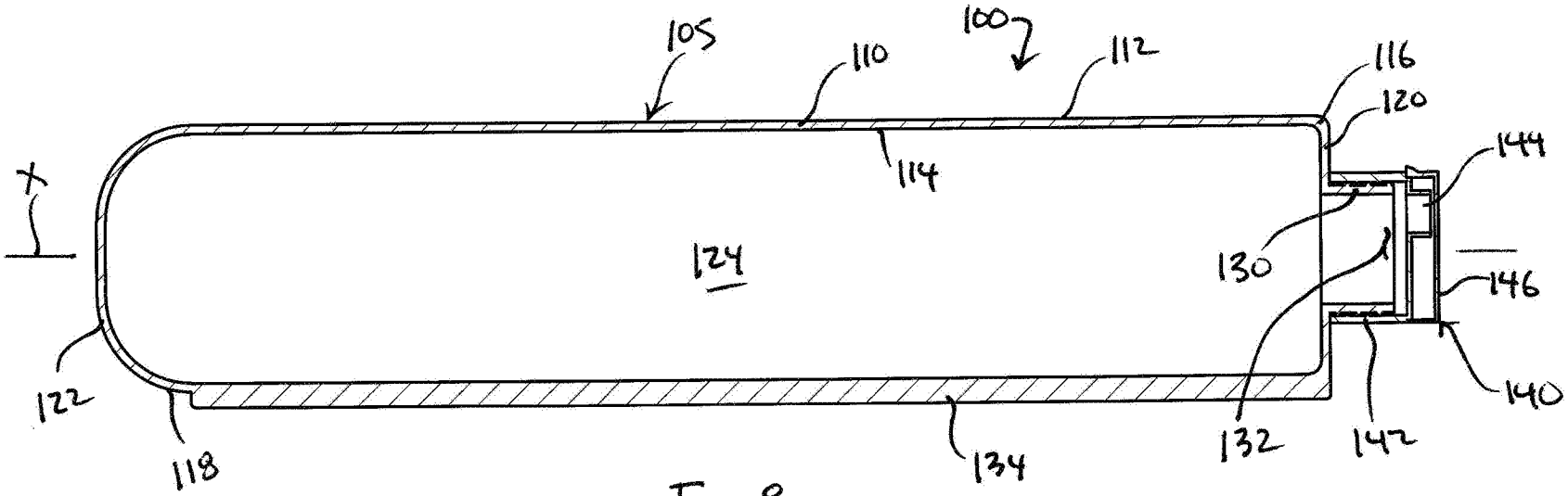
FIG. 8 is a section view taken along line 8-8 of FIG. 3.

Neck 130 is fitted with an attached suitable closure 140 that controls the discharge of the contents of container 100. Closure 140 normally closes dispensing opening 132 disabling the contents of container 100 from dispensing/spilling outwardly therefrom through dispensing opening 132. Closure 140 is movable from a first or closed position in FIGS. 1-6, and 8, wherein dispensing opening 132 is normally closed as shown in FIG. 8, and a second or open position in FIGS. 10-12, wherein dispensing opening 132 is open as shown in FIG. 12. Closure 140 is preferably configured to be movable repeatedly between its first or closed position in FIGS. 1-6, and 8 and its second or open position in FIGS. 10-12 for enabling a user to selectively access container 100 contents as needed.

Figure 10:
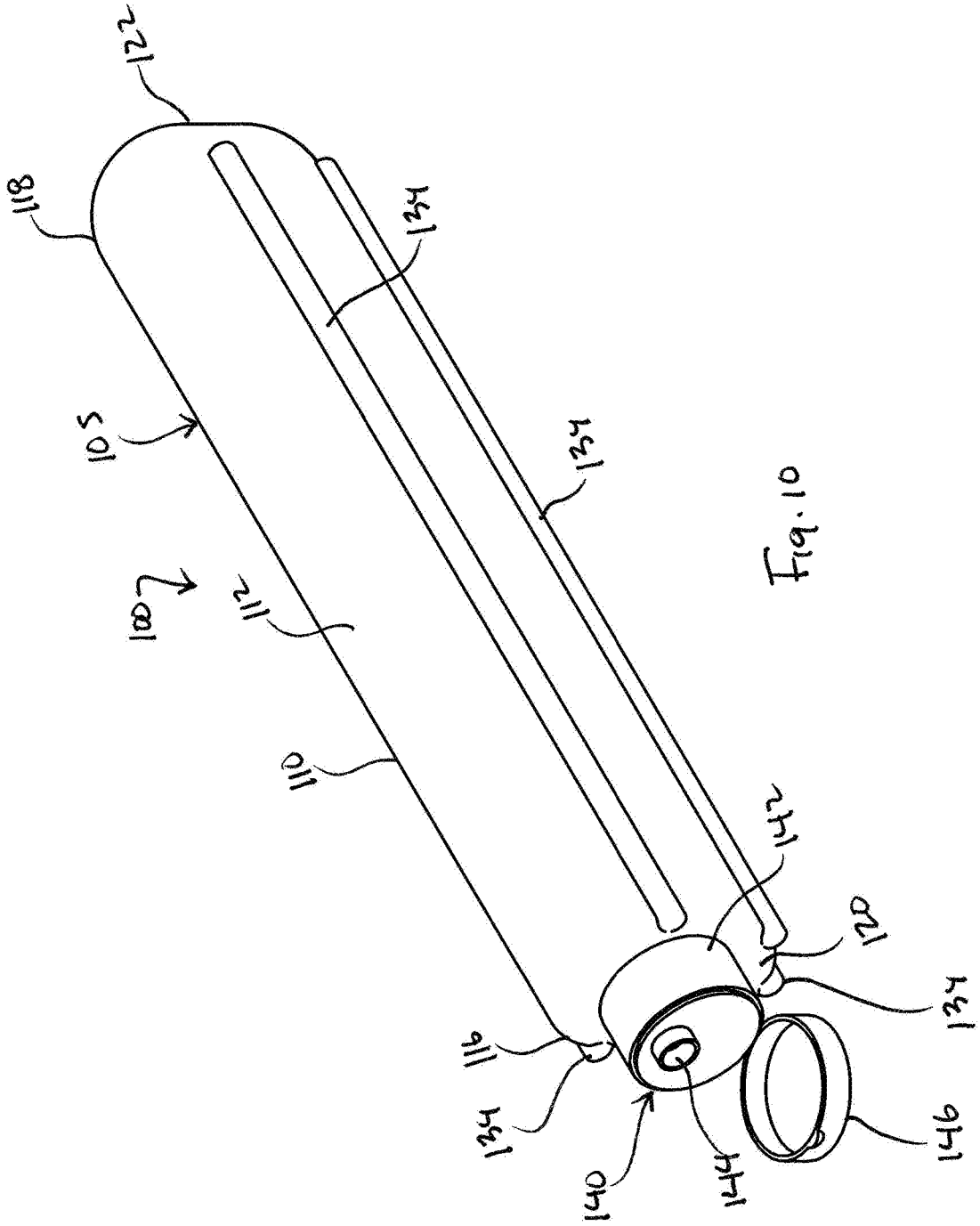
FIG. 10 is a view corresponding to FIG. 1 showing the closure as it would appear open.
Figure 11:
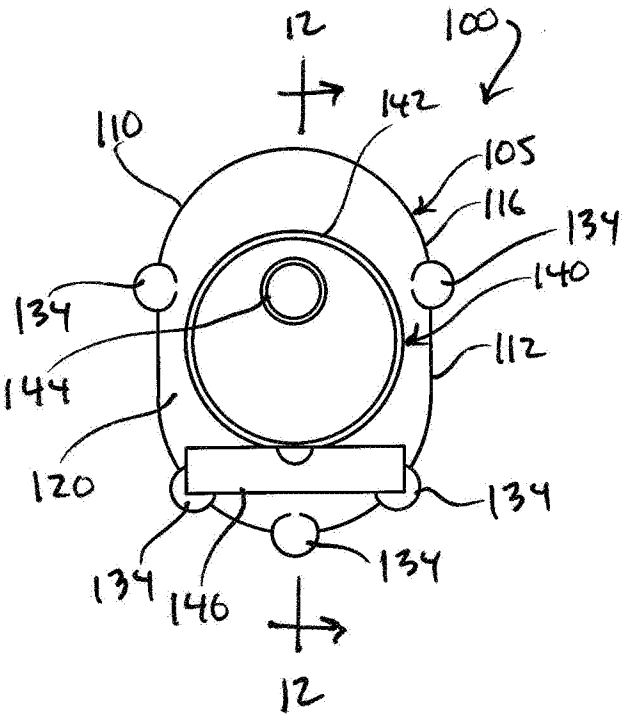
FIG. 11 is a rear elevation view of the embodiment of FIG. 10.
Figure 12:
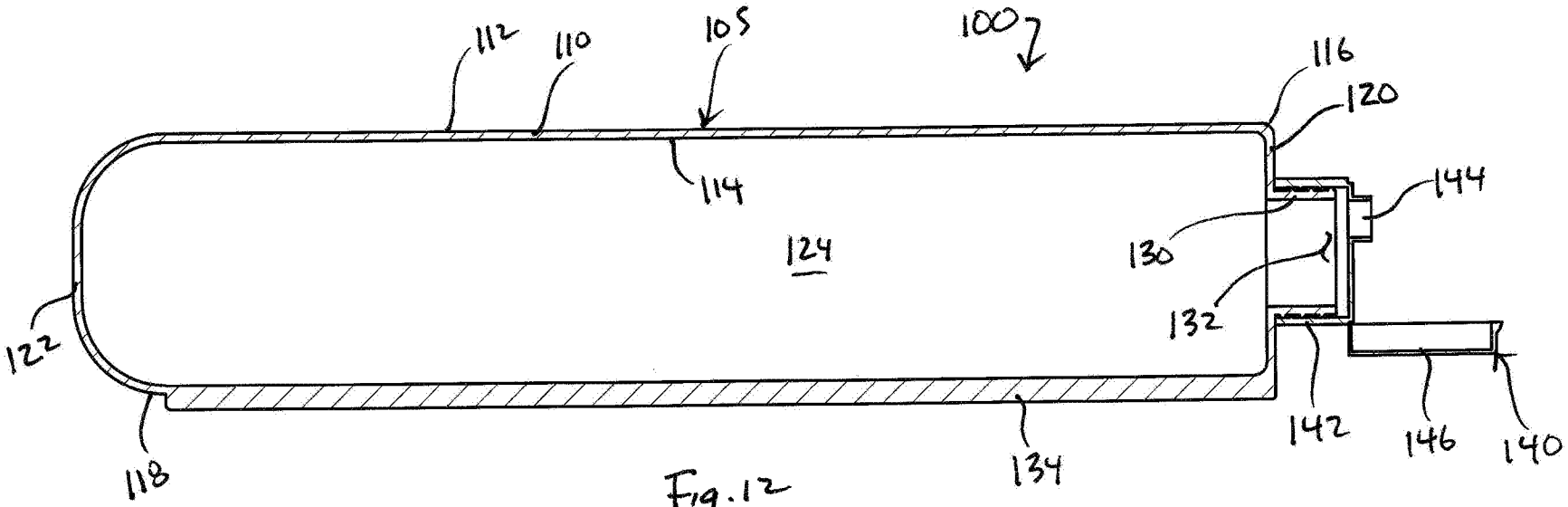
FIG. 12 is a section view taken along line 12-12 of FIG. 11.
Figure 13:
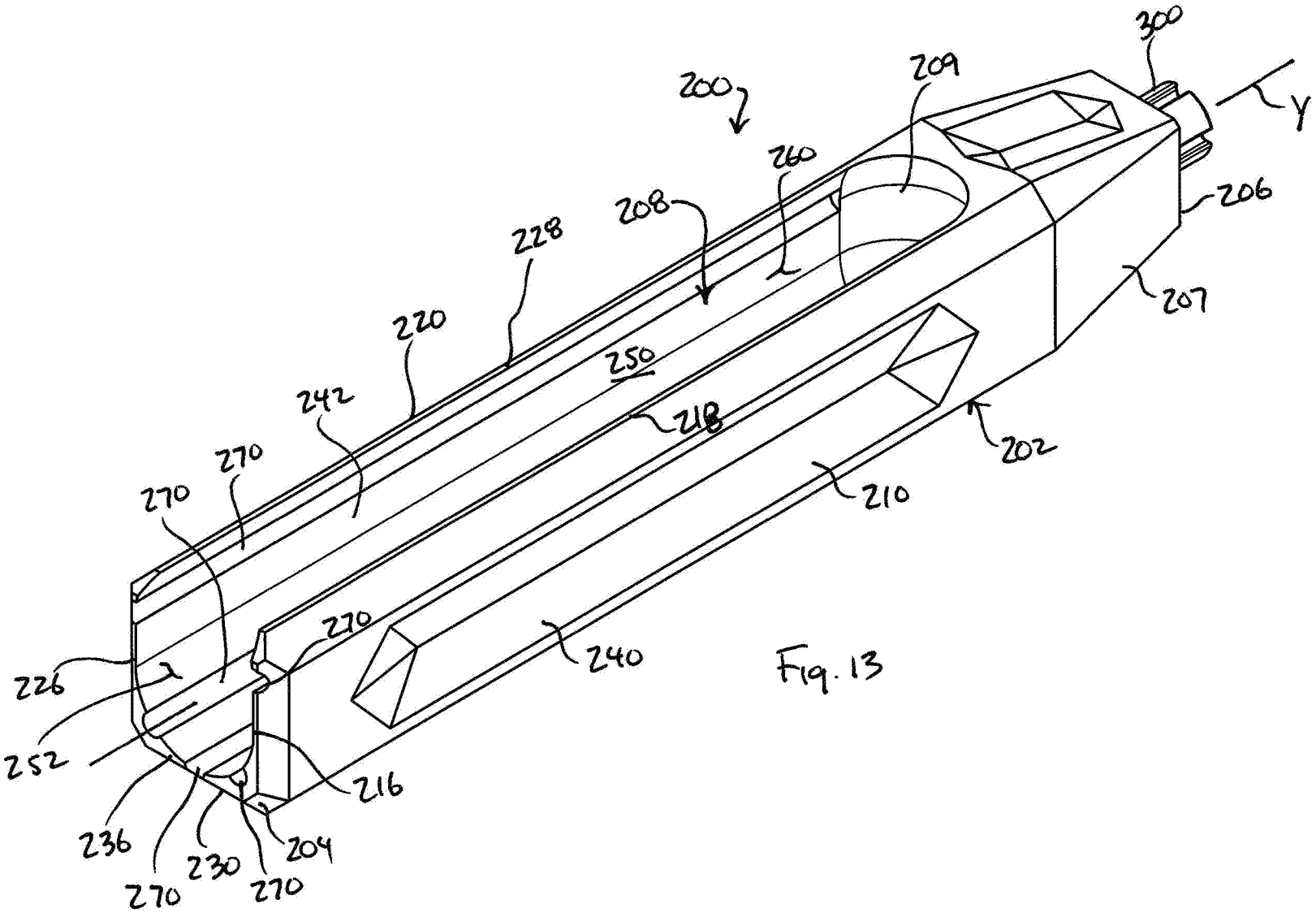
FIG. 13 is a rear perspective view of a handle constructed and arranged in accordance with the principle of the invention.
Figure 14:
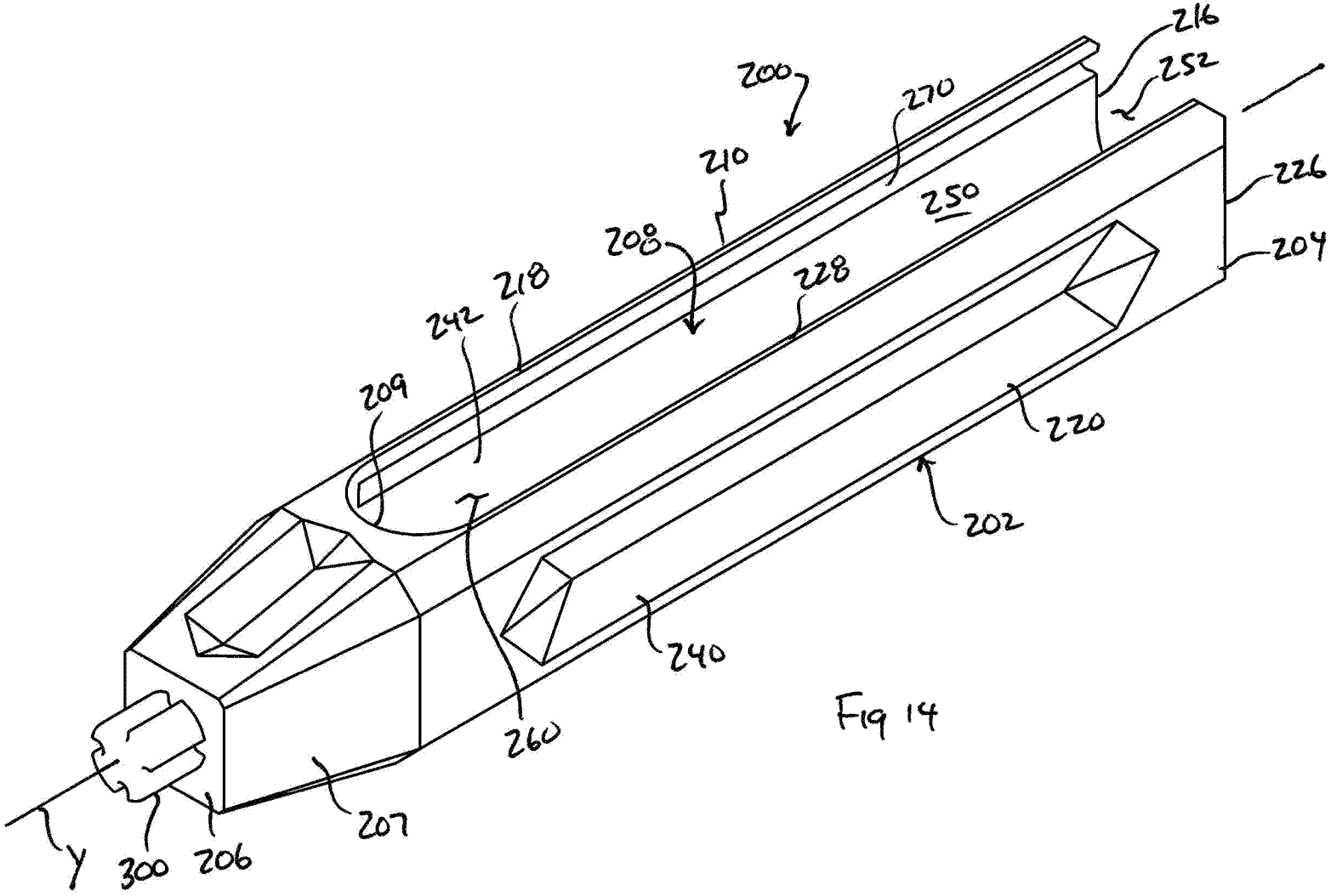
FIG. 14 is a front perspective view of the embodiment of FIG. 13.
Figure 15:
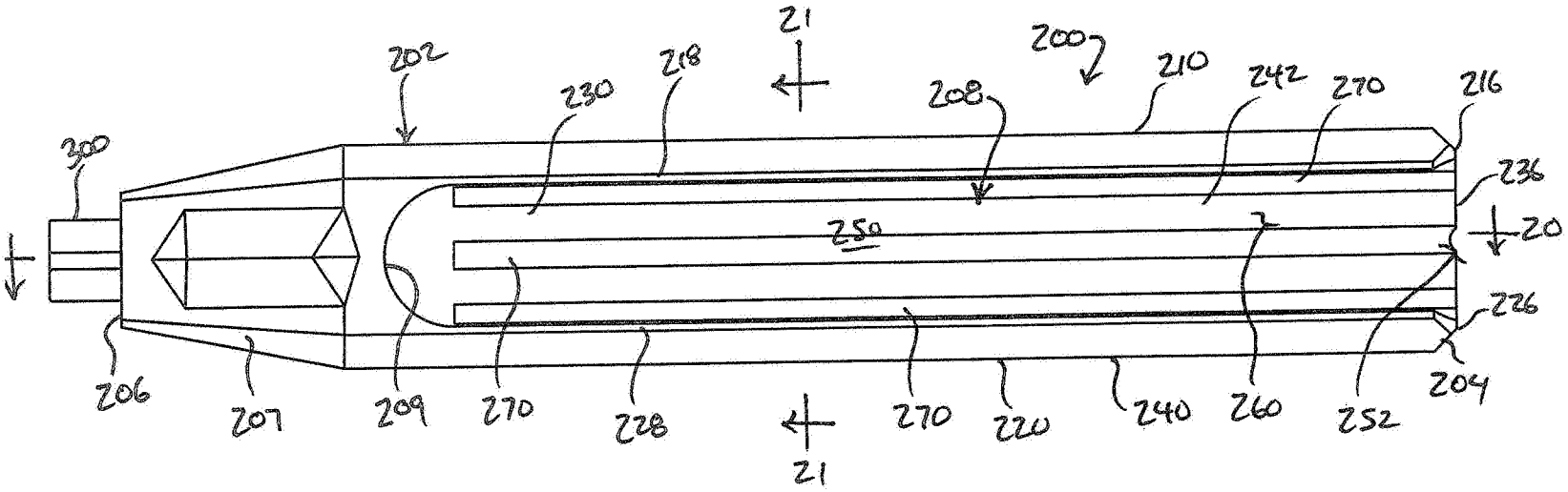
FIG. 15 is a top plan view of the embodiment of FIG. 13.
Figure 16:
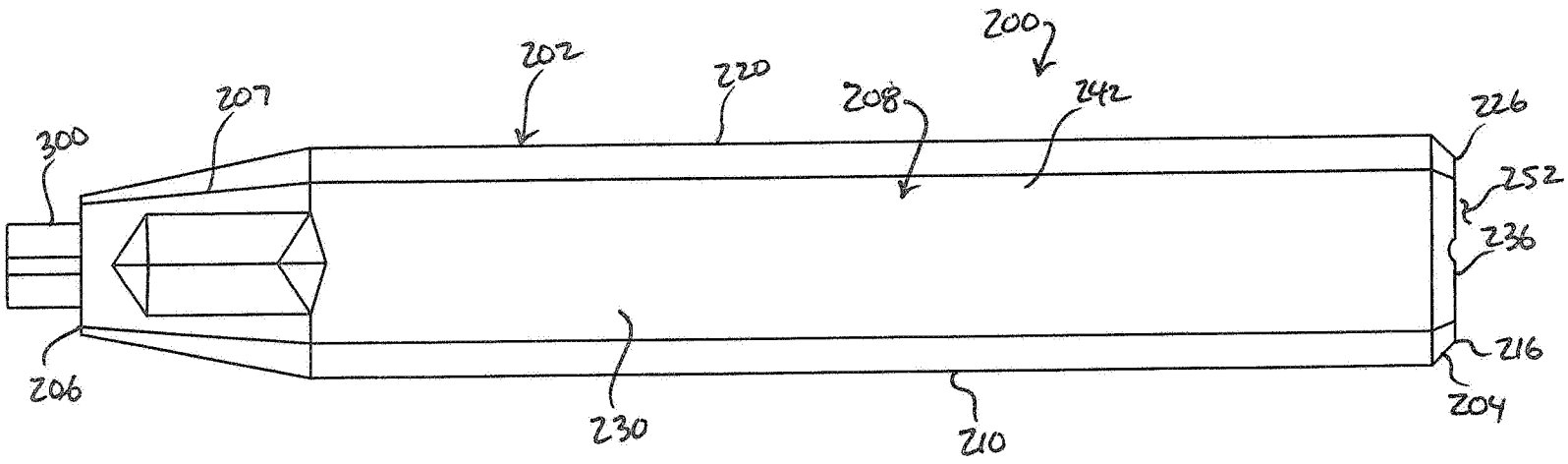
FIG. 16 is a bottom plan view of the embodiment of FIG. 13.
Figure 17:
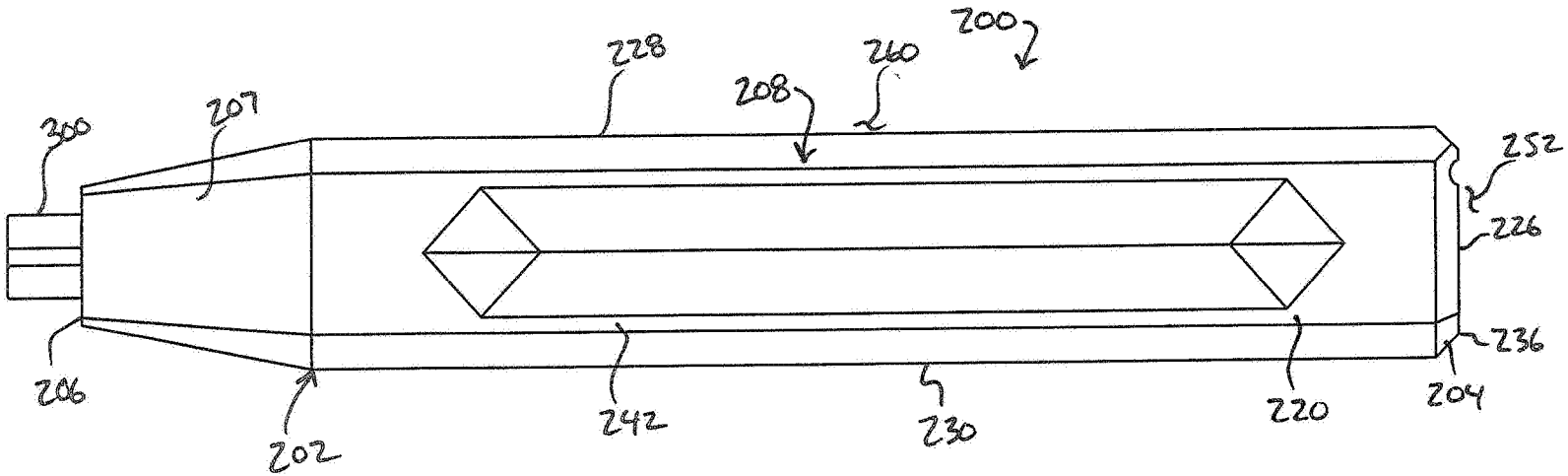
FIG. 17 is a side elevation view of the embodiment of FIG. 13, the opposite side elevation being the same thereof.
Figure 18:
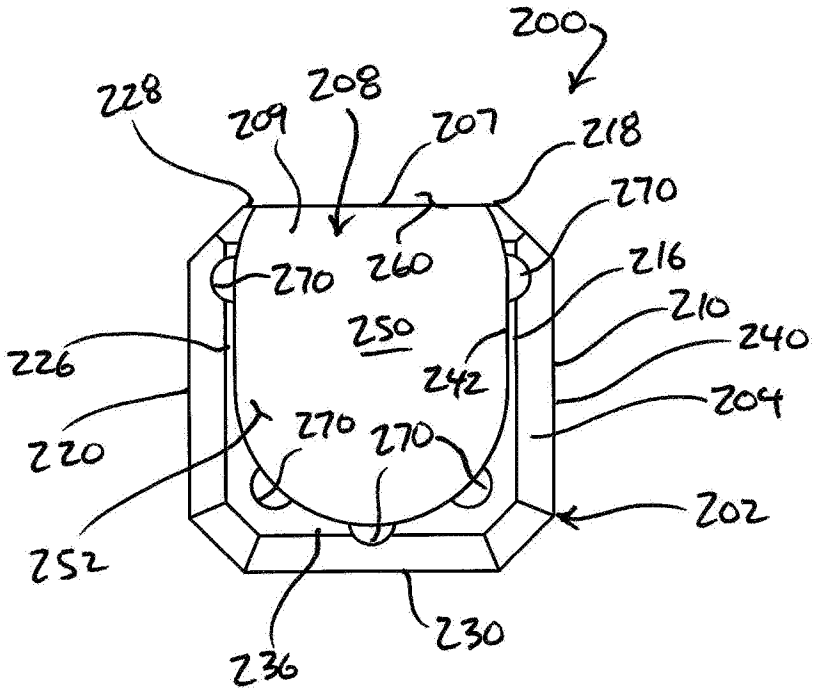
FIG. 18 is a rear elevation view of the embodiment of FIG. 13.
Figure 19:
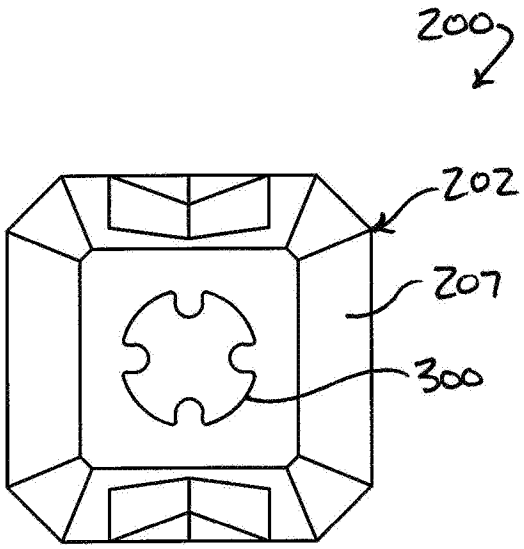
FIG. 19 is a front elevation view of the embodiment of FIG. 13.
Figure 20:
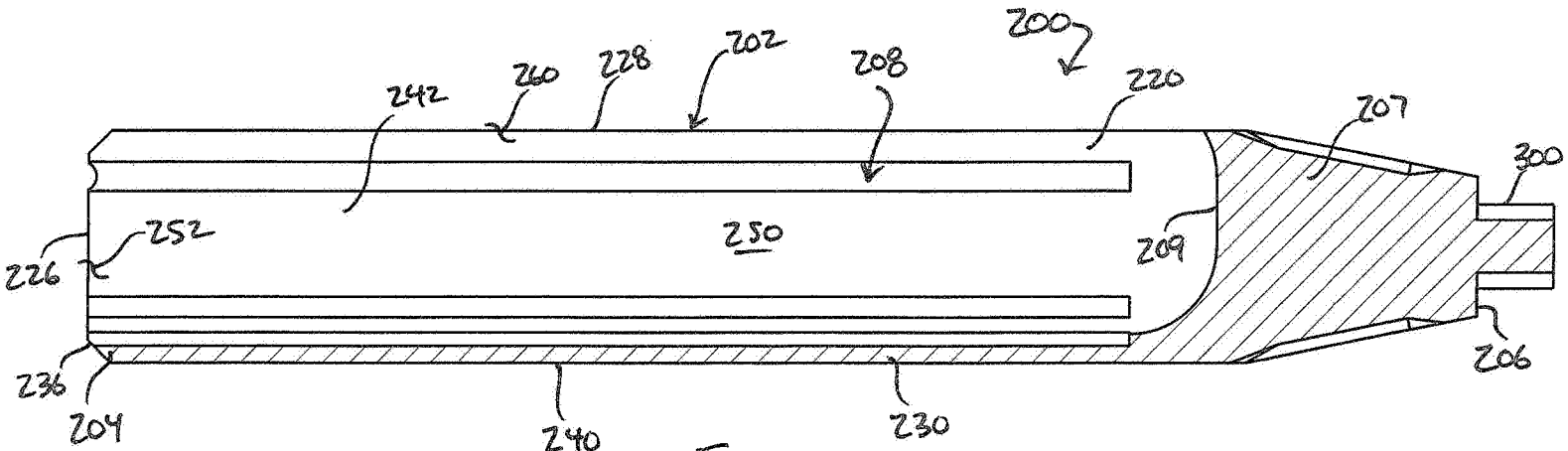
FIG. 20 is a section view taken along line 20-20 of FIG. 15.

In this example, closure 140 is a standard and well-known "flip-top" closure of plastic including cap 142, having a dispensing spout or port 144, and lid 146 mounted pivotally to cap 142 for movement between a closed position toward cap 142 in FIGS. 1-6, and 8 defining the first or closed position of closure 140 and an open position away from cap in FIGS. 10-12 defining the open position of closure 140. Closure 140 is closed when cap 142 is in its closed position and is open when cap 142 is in its open position. Cap 142 is fitted over neck 130 and over dispensing opening 132 that is open to port 144 in FIGS. 8 and 12. When cap 142 is pivoted to its closed position toward cap 142 and port 144 in FIG. 8, cap 146 fits over and closes port 144 thereby closing dispensing opening 132 disabling the contents of container 100 from dispensing through dispensing opening 132 from volume 124 and to and outwardly through port 144. When cap 14 is pivoted to its open position away from cap 142 and port 144 in FIG. 12, port 144 is free from cap 146 thereby opening dispensing opening 132 enabling the contents of container 100 to be dispensed through dispensing opening 132 from volume 124 and to and outwardly through port 144. Cap 142 and lid 146 are configured with mutually respective elements of a standard detent assembly well-known in the field of flip-top closures and that is configured to releasably retain lid 146 in its closed position. Neck 130 is outwardly threaded and cap 142 is correspondingly inwardly threaded and is threaded tightly over outwardly-threaded neck 130. In an alternate embodiment, neck 130 and cap 142 can include mutually respective elements of a detent assembly configured to snap-fit cap 142 over neck 130. A threaded cap, a quick-release cap, or other standard closure of the type commonly used with tubes of toothpaste, lotion, ointment, and the like and which can be configured to be opened or removed to enable container 100 to be squeezed to squeeze the contents of container 100 from within container 100 through dispensing opening 132 and closed or reattached to close dispensing opening 132 to disable the contents of container 100 from discharging through dispensing opening 132 can be used in place of closure 140.

Closure 140 is normally attached to neck 130 after filing volume 124 of container 100 with chosen contents, after which closure 140 can be selectively opened for dispensing the container 100 contents from container through dispensing opening 132 and closed for sealing any remaining contents in container 100. When container 100 is depleted, it can be discarded and replaced with a new one or closure 140 can be detached from neck 130 and then reattached after re-filling container 100 as before for reuse.

Referring now in relevant part to FIGS. 13-21, illustrated is a handle 200 configured to be assembled with container 100 to form a handle and container assembly 280 in FIGS. 22-32 according to the principle of the invention. Handle 20 is configured to accept and hold container 100 removably to enable it to be withdrawn from handle 200 when its contents are depleted and either replenished/refilled as described above and subsequently reassembled with handle 200 for reuse or replaced with a new one.

Handle 200 includes a body 202 having proximal extremity 204 and distal extremity 206. Body 202 is elongate and longitudinally straight from proximal extremity 204 to distal extremity 206, has a length from proximal extremity 204 to distal extremity 206, and is arranged about longitudinal axis Y that extends centrally through body 202 from proximal extremity 204 to distal extremity 206. The length of handle 200 body 202 from proximal extremity 204 to distal extremity 206 is sufficiently long, approximately three to five inches in length in this example, to enable it to be easily taken up by hand and used to wield and employ a personal care implement attached to distal extremity 206 for its intended purpose. Body 202 is formed of plastic, metal or other material or combination of materials having inherently strong, durable, rigid and resilient material characteristics and is without any moving parts and articulating joints and is thereby jointless. Body 202 is preferably integrally formed, such as by molding or machining and can, in an alternate embodiment, be formed of two or more assembled parts rigidly interconnected adhesively, by heat bonding, by one more fasteners, or other suitable joinery.

Body 202 is configured with a head 207 and a cradle, denoted generally at 208, both of which are arranged about axis Y. Cradle 208 longitudinally extends from head 207 and is configured to receive and hold container 100. Head 207 defines distal extremity 206 and longitudinally extends toward cradle 208 to an opposed end wall 209. Cradle 208 and its appurtenances longitudinally extend from end wall 209 of head 207 to proximal extremity 204. End wall 209 curves outwardly toward distal extremity 206 in opposition to proximal extremity 204. Proximal extremity 204 is open to cradle 208. This enables container 100 to be inserted through proximal extremity 204 into cradle 208 and withdrawn therethrough proximal extremity 204 from cradle 208 without having to modify or adjust either handle 200, including its cradle 208, or container 100.

Cradle 208 longitudinally extending from head 207 to proximal extremity 206 is generally U-shaped, being a generally U-shaped body portion of body 202, from proximal extremity 204 to end wall 209. Cradle 208 defines most of the length of body 202 and is defined by opposed, parallel and coextensive mutually respective longitudinal straight sidewalls 210 and 220 extending upright from either side of a longitudinally straight transverse bottom wall 230. Sidewalls 210 and 220 and bottom wall 230 are generally equal in length and concurrently extend longitudinally from head 207 and from end wall 209 of head 207 to proximal extremity 204.

Sidewalls 210 and 220 and bottom wall 230 cooperate to define an outer gripping surface 240 and an inner surface 242. Outer gripping surface 240 extends along the length of cradle 208 from head 207 to proximal extremity 204 and can be configured with external gripping features, such as eternal texturing and/or elastomeric features, for improved grip. Inner surface 242 is generally U-shaped as clearly illustrated and extends along the length of cradle 208 from end wall 209 of head 207 to proximal extremity 204. Outer gripping surface 240 and inner surface 242 concurrently follow the generally U-shaped configuration of cradle 208. The cross-section of cradle 208 can be the same from head 207 to proximal extremity 204, although it can vary in alternate embodiments depending on the chosen configuration of outer gripping surface 240. Inner surface 242 cooperates with end wall 209 to defines volume 250 of cradle 208. Volume 250 is configured to slidably receive container 100 through opening 252 of proximal extremity 204.

Sidewalls 210 and 220 and bottom wall 230 and inner surface 242 they define extend longitudinally from end wall 209 and terminate proximally at proximal extremity 204 with edges 216, 226, and 236, respectively. Edges 216, 226, and 236 are end edges and cooperate to define a generally U-shaped opening 252 that is open to volume 250. Accordingly, proximal extremity 204 is open to cradle 208, meaning that proximal extremity 204 is open to volume 250 via opening 252.

Sidewalls 210 and 220 terminate upwardly from bottom wall 230 with mutually respective longitudinal edges 218 and 228. Volume 250 is longitudinally straight, arranged about longitudinal axis Y, generally U-shaped from end wall 209 of head 207 to proximal extremity 204, and extends upright from bottom wall 230 to longitudinal opening 260 defined by edges 218 and 228. Volume 250 has a length from end wall 209 of head 207 to opening 252 of proximal extremity 204 and is generally U-shaped along its length in accordance with the general U-shaped configuration of inner surface 242. Inner surface 252 is inwardly curved along bottom wall 230 and extends upright along the respective sidewalls 210 and 220 and in this embodiment curves inwardly slightly to the respective edges 218 and 228. The length of volume 250 is substantially equal to the length of container 100 from bottom 122 to shoulder 120.

Edges 218 and 228, the upper edges of the respective sidewalls 210 and 220, are spaced apart and parallel to one another and to longitudinal axis Y, concurrently extend from either side of end wall 209 to edges 216 and 226, respectively, and define elongate opening 260 that follows volume 250 and extends between head 207 and proximal extremity 204. Edges 218 and 228 are slightly in-turned toward one another in this example. Elongate opening 260 that follows volume 250 longitudinally extends between end wall 209 of head 207 and opening 252 of proximal extremity 204, is open to opening 252, is parallel to longitudinal axis Y, and is open to volume 250 longitudinally from opening 252 at proximal extremity 204 to end wall 209 of head 207. Accordingly, cradle 208 of handle 200 is open longitudinally by elongate opening 260 longitudinally extending from opening 252 at proximal extremity 204 to end wall 209 of head 207 and is thus circumferentially incomplete from opening 252 to end wall 209 of head 207. Elongate opening 260 has a length from opening 252 of proximal extremity 252 to head 207, specifically to end wall 209 of head 207.

Figure 21:
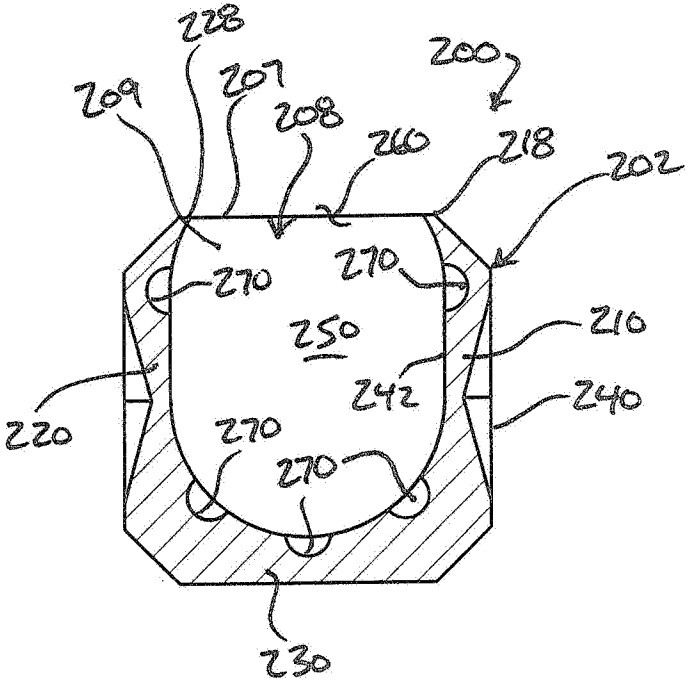
FIG. 21 is a section view taken along line 21-21 of FIG. 15.
Figure 22:
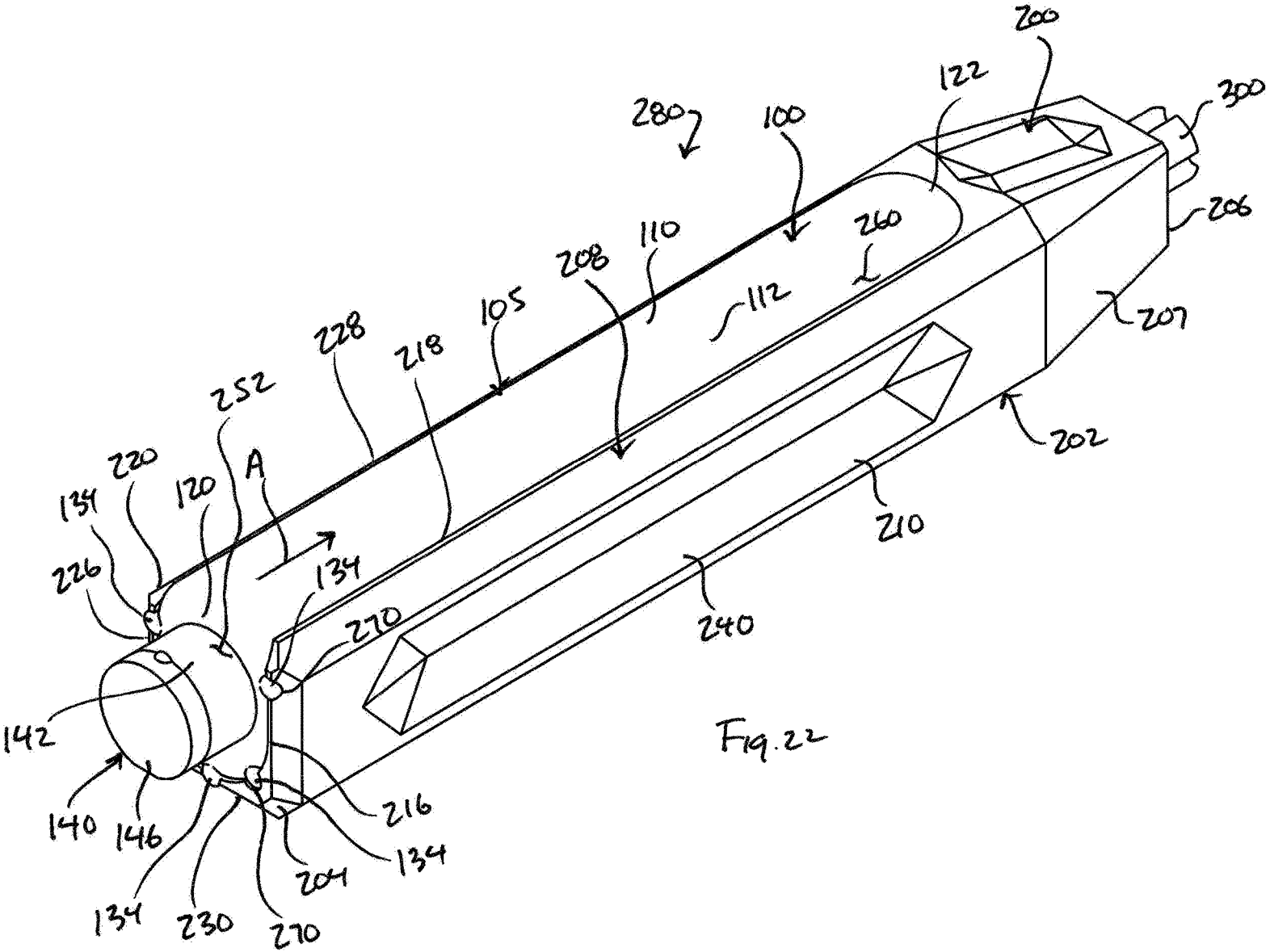
FIG. 22 is a rear perspective of the embodiment of FIG. 1 and the embodiment of FIG. 13 shown as they would appear assembled to form a handle and container assembly.
Figure 23:
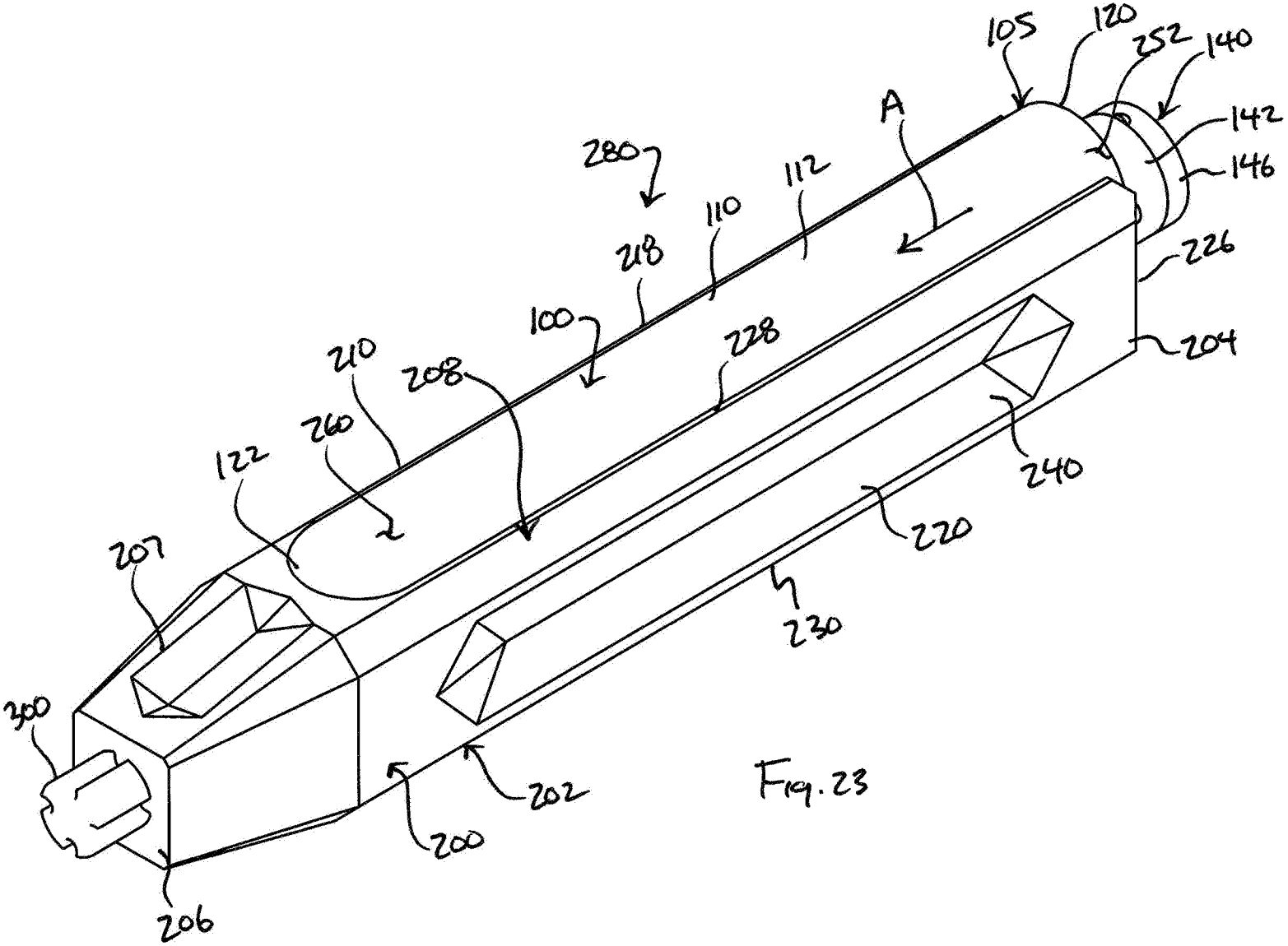
FIG. 23 is a front perspective view of the embodiment of FIG. 22.
Figure 24:
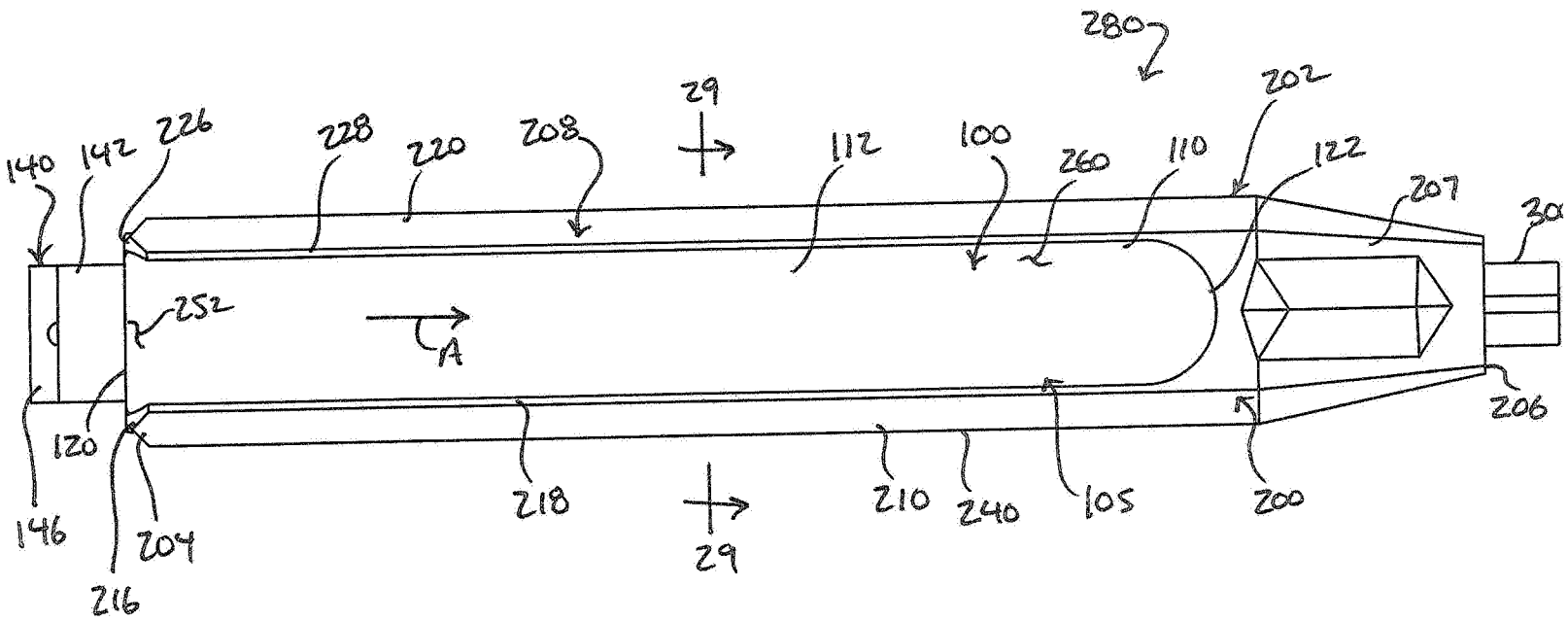
FIG. 24 is a top plan view of the embodiment of FIG. 22.
Figure 25:
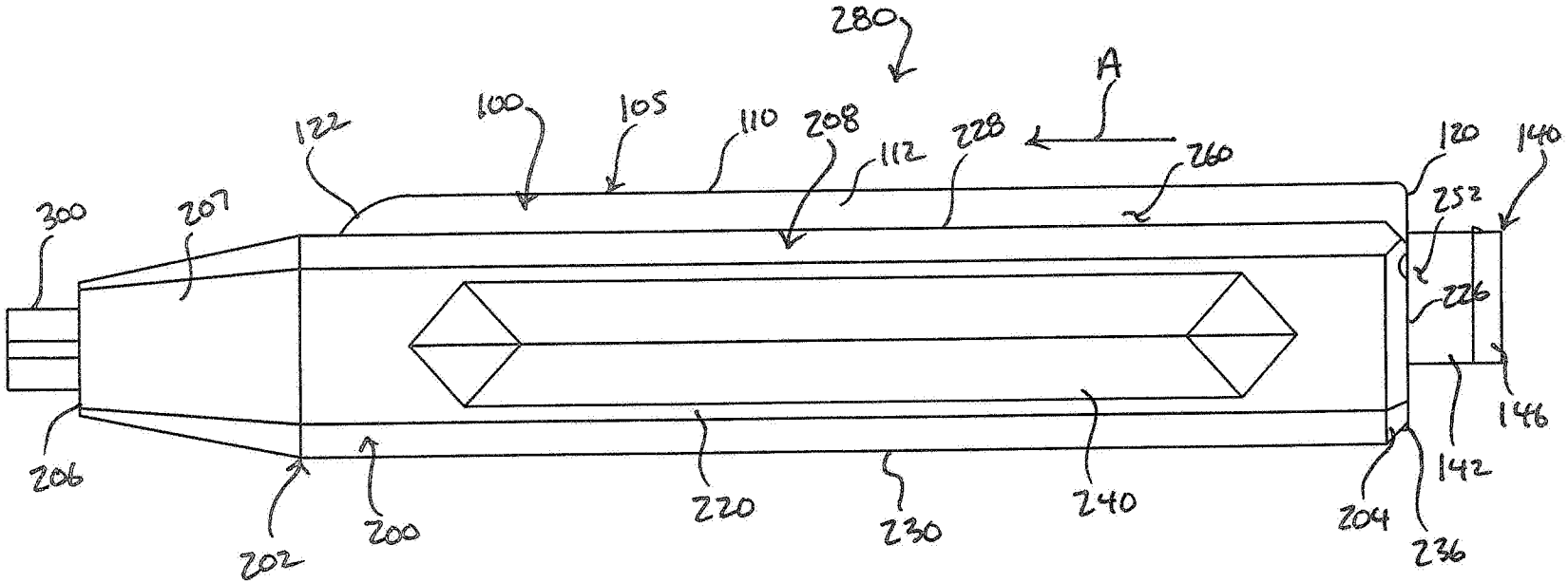
FIG. 25 is a side elevation view of the embodiment of FIG. 22, the opposite side elevation being the same thereof.
Figure 26:
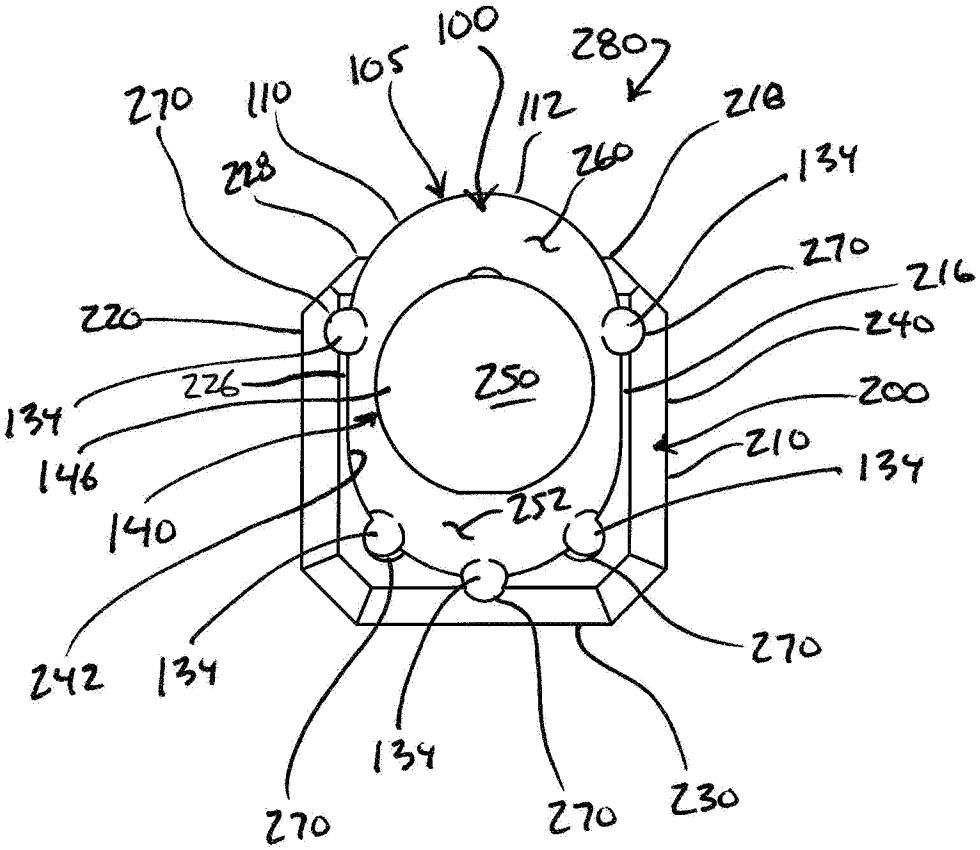
FIG. 26 is a rear elevation view of the embodiment of FIG. 22.
Figure 27:
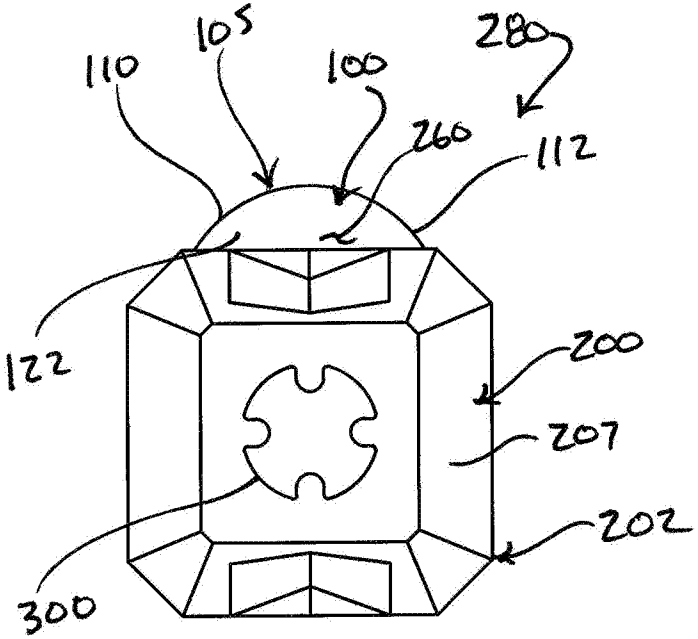
FIG. 27 is a front elevation view of the embodiment of FIG. 22.

Inner surface 242 of cradle 208 is configured with rib-receiving races or grooves 270. Grooves 270 are open to volume 250 and circumferentially spaced apart. Grooves 270 are parallel to each other and to longitudinal edges 218 and 228 and longitudinal axis Y, identical and coextensive and longitudinally extend along the length of cradle 208 between end wall 209 of head 207 and opening 252 of proximal extremity 204. Each groove 270 is longitudinally straight and unbroken from end-to-end, one end being proximate to end wall 209 of head 207 and the other being proximate to opening 252 of proximal extremity 204. Grooves 270 correspond spatially and in number to, and are sized and shaped to receive slidably, the corresponding ribs 134 of container 100. In FIG. 21, one groove 270 is formed in inner surface 242 of sidewall 210 proximate to edge 218, one groove is formed in inner surface 242 of sidewall 220 proximate to edge 228, and three grooves 270 are formed along the inwardly curved inner surface 252 of bottom wall 230 all for relating to the container 100 ribs 134. The cross-sectional shape of cradle 208 illustrated in FIG. 21 is the same or otherwise uniform along its length between end wall 209 and opening 252 of proximal extremity 204.

Cradle 208 and container 100 are configured to enable cradle 208 to accept/receive container 100 slidably in volume 250 bottom 122 first through opening 252 of proximal extremity 204 and to enable container 100 to be withdrawn slidably from volume 250 through opening 252 of proximal extremity 204 all without having to modify or adjust handle 200 or container 100 as explained above. In other words, container 100 is movable slidably into and out of an installed position in volume 250 of cradle 208 via opening 252. The longitudinally extending grooves 270 open to volume 250 are configured to accept/receive slidably the respective longitudinally extending ribs 134 of container 100 when container 100 is received slidably bottom 122 first into volume 250 through opening 252 of proximal extremity 204.

Ribs 134 of container 100 and rib-receiving grooves 270 of cradle 208 serve as a retention assembly. This retention assembly serves to releasably retain container 100 frictionally and positionally to cradle 208, when container 100 is inserted slidably bottom 122 first into volume 250 through opening 252 and grooves 270 receive the respective ribs 134 slidably. Each rib 134 and corresponding groove 270 constitute a retention pair, one of the rib 134 and groove 270 being the element of the retention pair and the other of the rib 134 and groove 270 being the complement element of the retention pair. In each retention pair, container 100 carries rib 134 and cradle 208 carries the corresponding groove 270. This arrangement can be reversed in an alternate embodiment. The assembly of container 100 and handle 200 will now be discussed.

Container 100 and handle 200 are assembled in FIGS. 22-31 forming a handle and container assembly denoted generally at 280. As explained above, handle 200 is configured to accept and hold container 100 removably to enable it to be withdrawn from handle 200 when depleted of its contents and either replenished/refilled and subsequently reassembled with handle 200 or replaced with a new one.

Container 100 and handle 200 are assembled by aligning container inline with volume and concurrently registering bottom 122 of container 110 with opening 252 of proximal extremity 204 and registering ribs 134 of container 100 with the corresponding grooves 270 of cradle 208. Container 100 is then inserted into volume 250 simply by sliding it bottom 122 first into and through volume 250 through open end 252 of proximal extremity 204 in the direction of arrow A in FIGS. 22-25 and 28 until bottom 122 of container 100 comes into direct contact against end wall 209 of head 207 in FIG. 28, which arrests container 100 from advancing beyond end wall 209. At the same time, ribs 134 slide through the corresponding grooves 270 and a longitudinally part/extent 110A of continuous sidewall 110 of container 100 between bottom 122 and shoulder 120, its outwardly rounded upper end in this example, slides longitudinally through elongate opening 260. Ribs 134 received slidably by the corresponding grooves 270 serve to frictionally and positionally retain container 100 in place in volume 250.

Once container 100 is installed slidably into cradle 208 through proximal extremity 204, container 100 longitudinally extends through volume 250 from bottom 122 proximate to end wall 209 of head 207 to shoulder 120 at opening 252 of proximal extremity 204 and dispensing opening 132 of neck 130 proximate to opening 252. Neck 130 extends longitudinally outward/outboard from shoulder 120 and opening 252 to dispensing opening 132. The attached closure 140 that normally closes dispensing opening 132 follows neck 130 and thereby extends longitudinally outward/outboard from shoulder 120 and opening 252 of proximal extremity 204 to enable movement of closure 140 between its first or closed position in FIGS. 22-25, and 28 and its second or open position in FIGS. 30 and 31 without interference from handle 200 when container 100 is installed in cradle 208 in accordance with the principle of the invention. The outer surface 112 of continuous sidewall 110 is received frictionally against inner surface 242 of cradle 208. Specifically, the outer surface 112 of the outwardly rounded lower end of continuous sidewall 110 extends against and across the inwardly curved inner surface 242 of bottom wall 230. The outer surface 112 of the opposed sides of continuous sidewall 110 extends upright against and along the inner surface 242 of the respective sidewalls 210 and 220 to the respective edges 218 and 228. The longitudinal extent/part 110A of continuous sidewall 110 of container 100, the outwardly rounded upper end of continuous sidewall 110 longitudinally extending between bottom 122 and shoulder 120, extends laterally outward from cradle 208 through elongate opening 260 and beyond longitudinal edges 218 and 228 between head 207 and proximal extremity 252. The described operation for assembling container 100 with handle 200 need only be reversed to slidably withdraw container 100 from volume 250 of cradle 208 through opening 252 of proximal extremity 204.

Inner surface 242 of cradle 208 extends partially around container 100 from edge 218 at one side of the rounded upper end of container 100 to edge 228 at the other side of the rounded upper end of container 100 along the length of container 100 between bottom 122 of container 100 to shoulder 122 of container 100. The remaining longitudinal part 110A of container 100, the outwardly rounded upper end of continuous sidewall 110 between bottom 122 at the outer end of container 100 and shoulder 120 at the inner end of container 100, extends laterally outward from longitudinal edges 218 and 228 of cradle 208 through the length of elongate opening 260 between bottom 122, the outer end of container 100, at end wall 209 of head 207 to opening 252 and shoulder 120, the inner end of container 100, at proximal extremity 204 and is thereby free of handle 200 and its cradle 208. Because cradle 208 of handle 20 is generally U-shaped and inherently circumferentially incomplete along its length from end wall 209 of head 207 to opening 252 at proximal extremity 204, cradle 208 of handle 200 is circumferentially completed by the longitudinal part 110A of container 100 extending laterally outward from cradle 208 through the length of elongate opening 260 from end wall 209 of head 207 to opening 252 at proximal extremity 204 to become comparatively easier to be held by hand when container 100 is assembled with handle 200, according to the principle of the invention.

Figure 32:
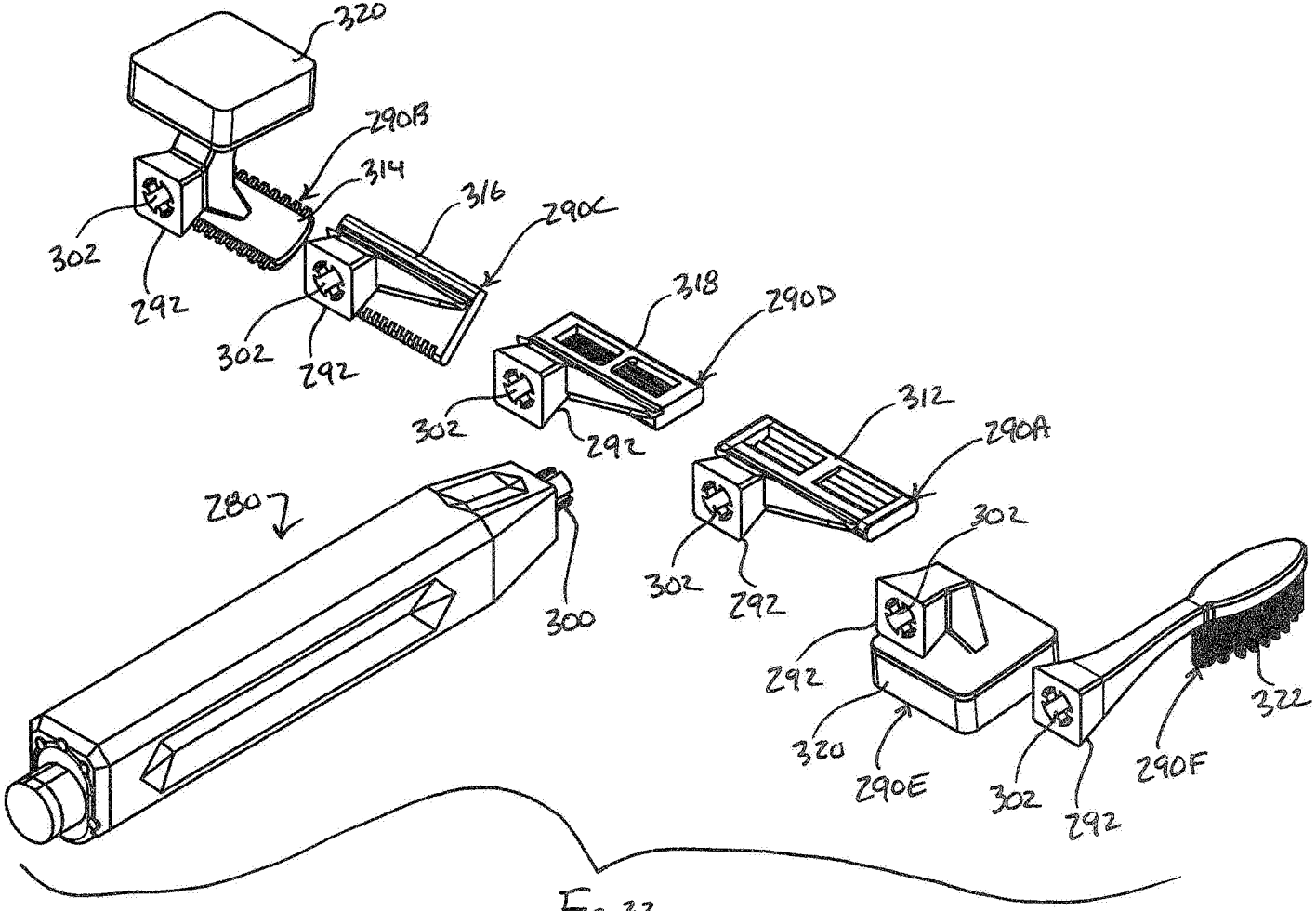
FIG. 32 is a perspective view of a plurality of personal care implements each configured to be attached to the embodiment of FIG. 22.

Handle and container assembly 280 is configured for use with personal care implements, such as personal care implements 290 in FIG. 32. Each personal care implement 290 is carried by a corresponding base or head each denoted at 292. Each base or head 292 is a supporting body of plastic, metal, or other material or combination of materials having inherently durable, rigid, and resilient material characteristics and is considered part of or an extension of the associated implement 290. Distal extremity 206 and each head 292 are configured with an engagement assembly useful for selectively releasably connecting one to the other to form various personal care devices useful for personal care purposes, such as shaving, cleaning, cosmetic application, or other chosen personal care purpose. An engagement assembly will now be discussed in conjunction with handle 200 and head 292 of implement 290A. The ensuing discussion of the engagement assembly applies equally to the head 292 of each of the remaining implements 290B, 290C, 290D, 290E, and 290F.

With continuing reference to FIG. 32, distal extremity 206 is configured with the engagement element of the engagement assembly and implement 290A head 292 is configured with the complemental engagement element of the engagement assembly. In this example, the engagement element is a male engagement in the form of a radially notched pin 300 protruding outwardly from distal extremity 206. The complemental engagement element is a female engagement element in the form of a corresponding radially notched socket 302. Pin 300 is arranged about axis Y. Pin 300 and socket 302 releasably connect head 292 of implement 290A to distal extremity 206 of handle 200 in FIG. 33 when pin 300 is inserted slidably into socket 302 in FIG. 34. The assembly of implement 290A with handle and container assembly 280 form a handled personal care device denoted generally at 310 in FIG. 33. The marriage of radially-notched socket 302 over radially-notched pin 300 forms a durable and competent engagement and inherently disables implement 290A from rotating relative to handle 200. Although pin 300 is carried by handle 200 and socket 302 is carried by head 292 of implement 290A, this arrangement can be reversed so that the engagement element carried by head 207 is socket 302 and the complemental engagement element carried by head 292 of implement 290A is pin 300. The person having ordinary skill will readily appreciate that other forms of engagement and complemental engagement assemblies can be used for releasably connecting head 292 of implement 290A to distal extremity 206 of handle 200, such as complementing male and female threaded engagement elements, complementing snap or detent engagement elements, and the like.

Figure 33:
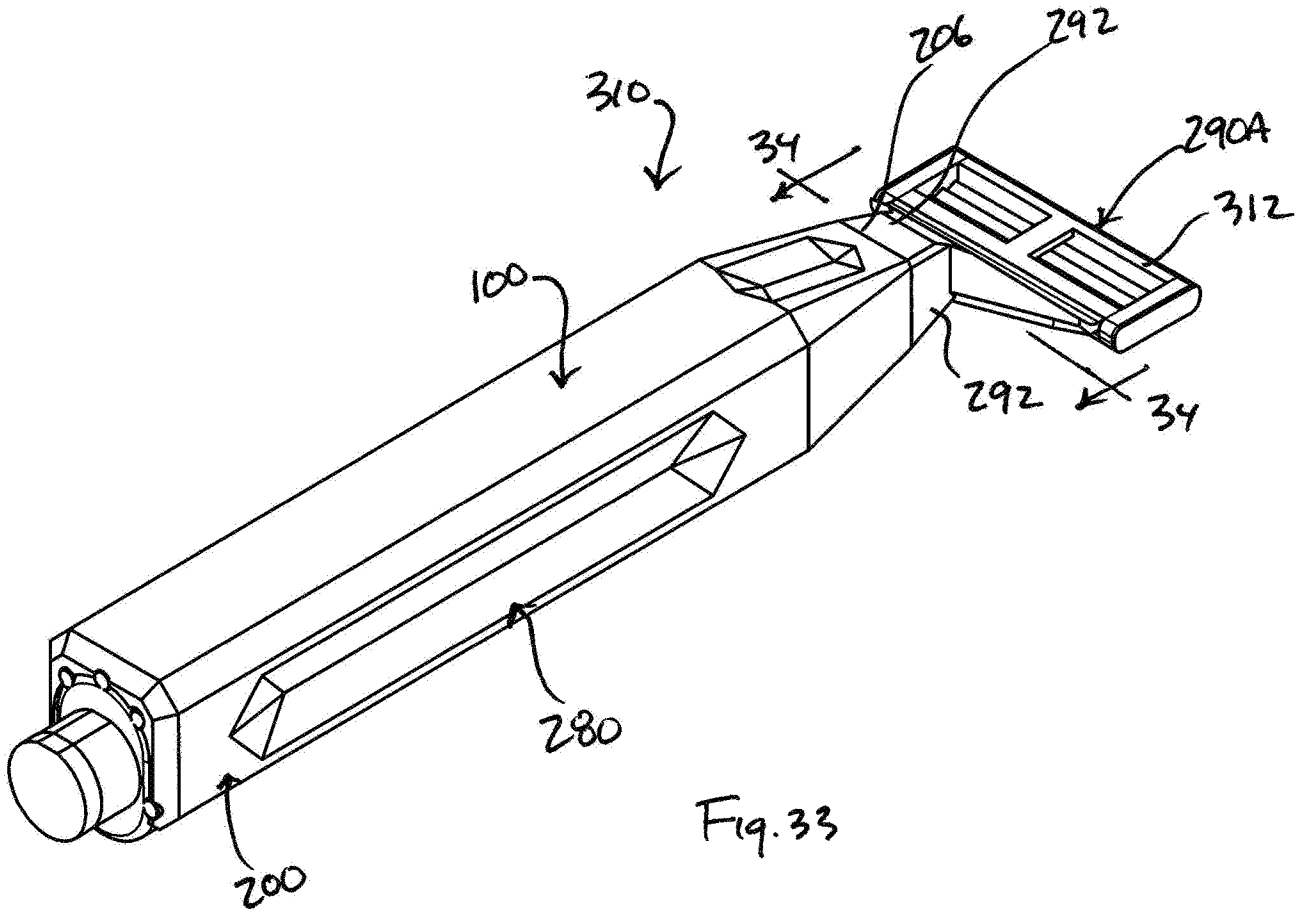
FIG. 33 is a perspective view corresponding to FIG. 32 illustrating one of the personal care implements as it would appear attached to the embodiment of FIG. 22.
Figure 34:
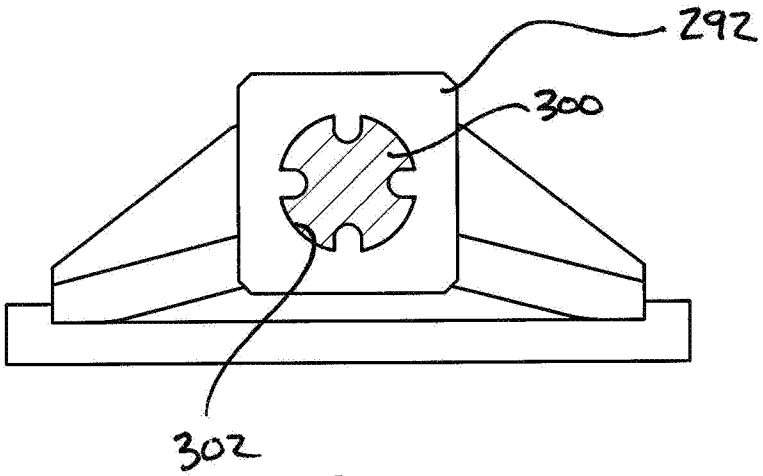
FIG. 34 is a section view taken along line 34-34 of FIG. 33.

Implement 290A is a standard multi-blade cartridge 312, a known multi-bladed tool primarily used to remove unwanted body hair through the act of wet shaving. Accordingly, personal care device 310 in FIG. 33 is a handled razor useful for standard wet shaving and at the same time provides convenient storage and access to contents of container 100 held by handle 200 without having to look elsewhere. Handle assembly 280 of personal care device 310 is taken up by hand and used to glide implement 290A over the skin to shave away unwanted body hair. Since personal care device 310 is a razor, the contents of container 100 are preferably a shaving-associated cosmetic useful in conjunction with shaving, such as a shaving cream, a shaving gel, or a liquid shaving soap applied to the face or chosen body portion to facilitate shaving, a pre-shave lotion or balm applied to the face or chosen body portion before shaving, or an aftershave lotion, balm, gel, paste, alcohol-based liquid, or the like applied to the skin after shaving, according to the principle of the invention.

Figure 28:
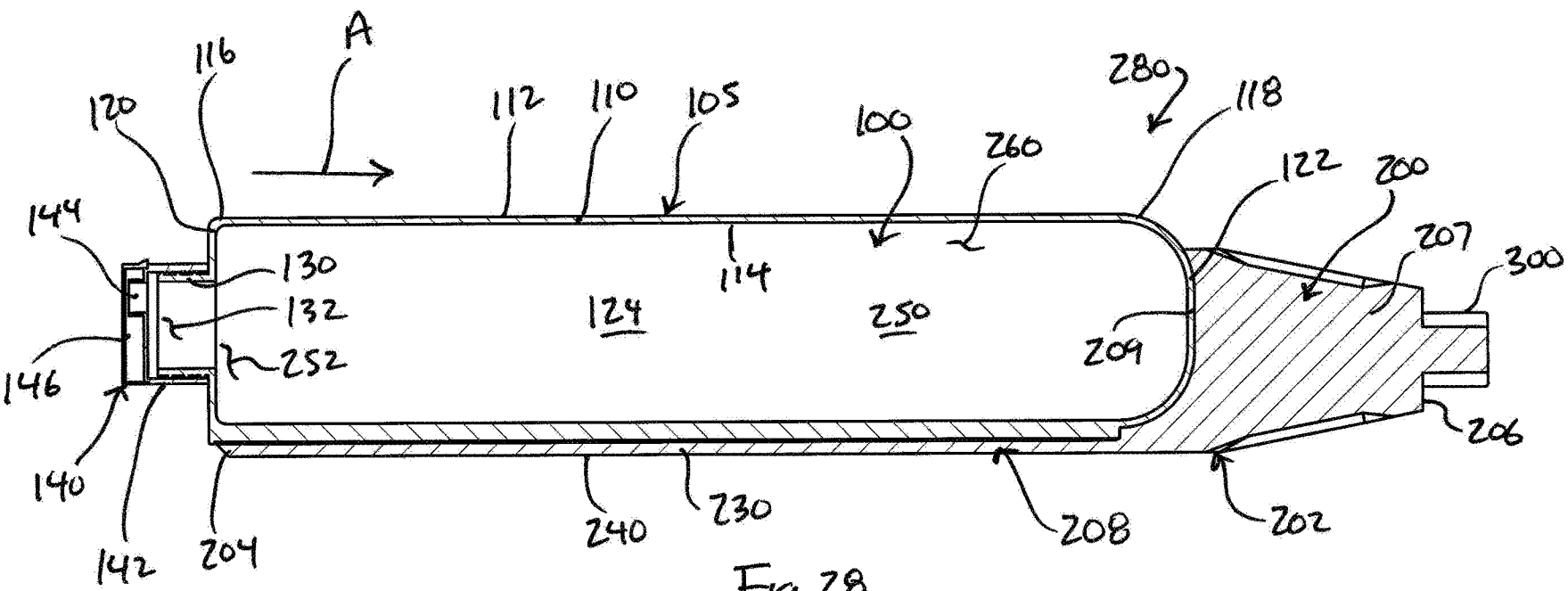
FIG. 28 is a section view taken along line 28-28 of FIG. 24.
Figure 29:
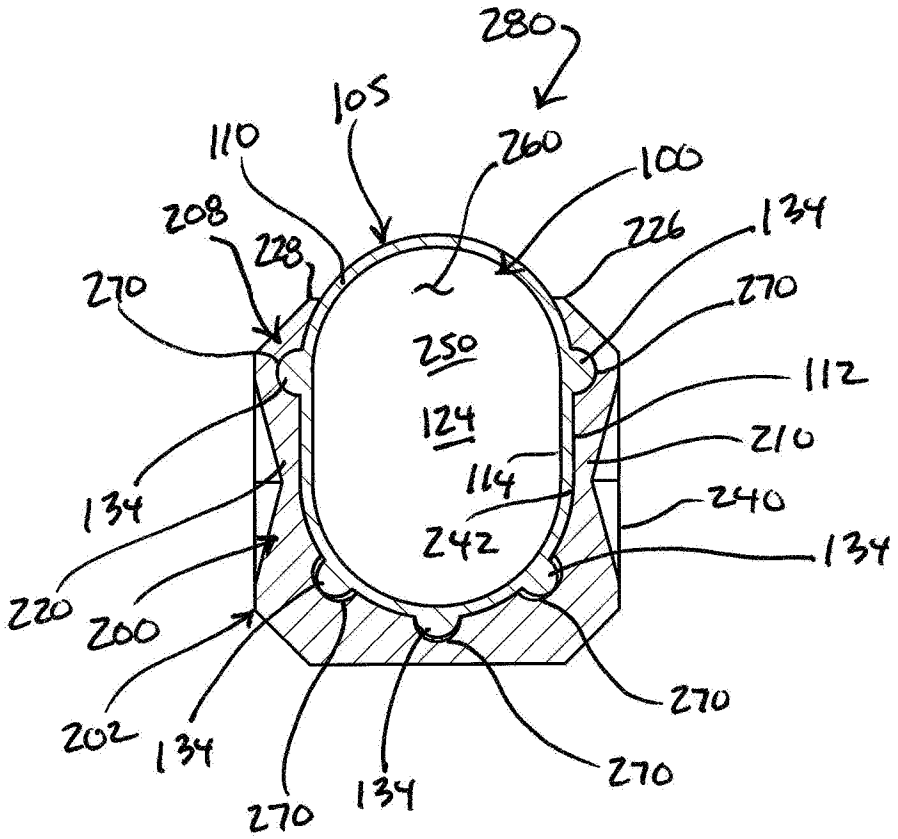
FIG. 29 is a section view taken along line 29-29 of FIG. 24.
Figure 30:
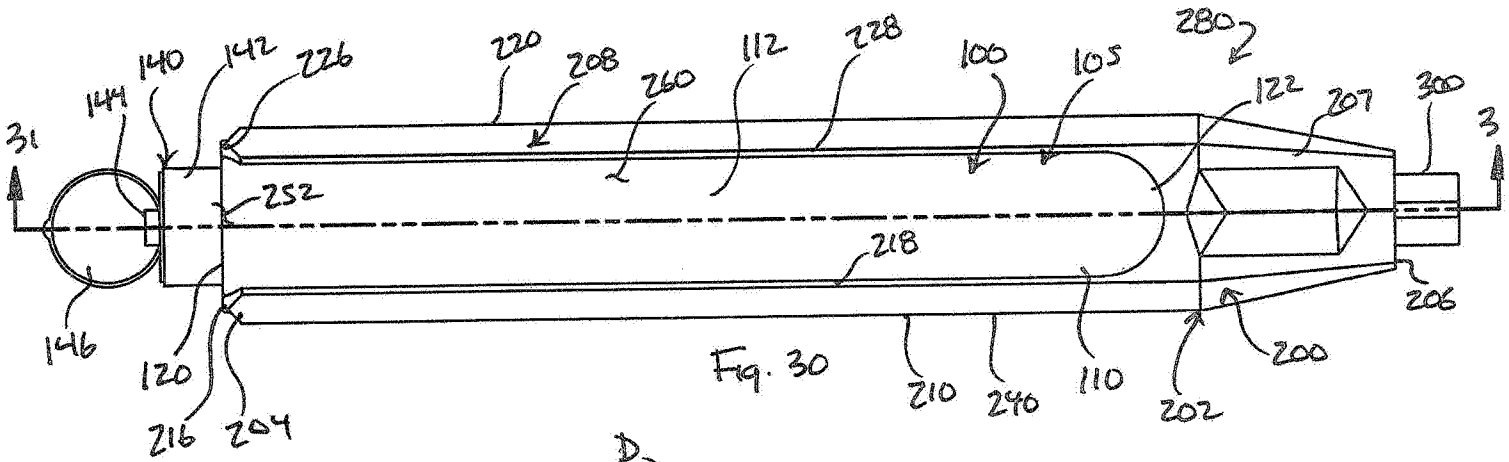
FIG. 30 is a top plan view corresponding to FIG. 24 illustrating the closure as it would appear open.
Figure 31:
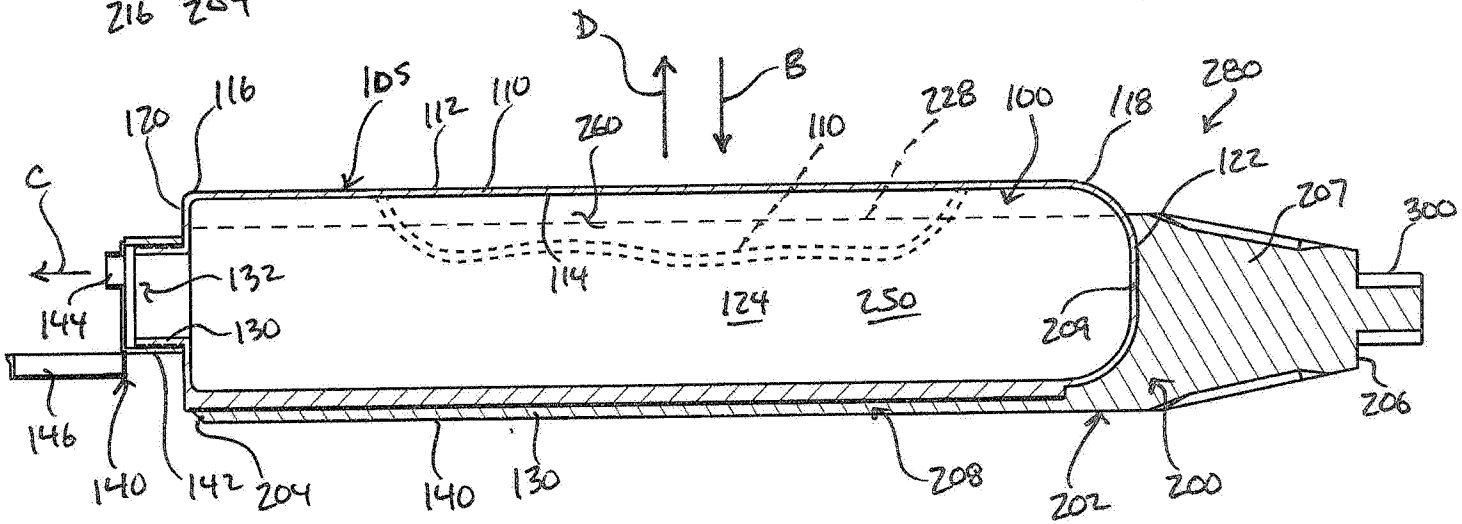
FIG. 31 is a section view taken along line 31-31 of FIG. 30.

Access to the contents of container 100 is enabled by the structure of handle and container assembly 280. To conveniently access the contents of container 100, the shaving-associated contents of container 100 in this example, the user need only open dispensing opening 132 by opening closure 140 in FIG. 31 by hand and then press against longitudinal part 110A of continuous sidewall 110 of container 100 in the direction of arrow B to deform it into volume 50 through elongate opening 260 as denoted for example by the dotted outline of continuous sidewall 110 in FIG. 31. This serves to squeeze container 100 against the supporting inner surface 242 of cradle 208 to, in turn, squeeze the contents in volume 124 of container 140 outwardly through port 144 in the direction of arrow C from dispensing opening 132. The user need only close closure 140 as shown in FIG. 28 to close dispensing opening 132 as previously described upon dispensing a chosen amount of the container 100 contents, which is used according to its intended purpose. The resiliently deformable material characteristic of container 100 enable it to spring back, rebound, or otherwise return to an original form outwardly from volume 250 through elongate opening 260 in the direction of arrow D in FIG. 31, an un-deformed or un-collapsed form of container 100 represented in solid line, after being deformed/collapsed by being squeezed.

Again, the contents of container 100 are shaving-associated contents that relate to the use of implement 290A for shaving, such as a pre-shaving cosmetic applied to the skin before shaving, a shaving cosmetic applied to the skin for shaving with personal care device 310, or an aftershave cosmetic used after shaving, which is selectively dispensed and used according to its intended use whether before, during, or after shaving, according to the principle of the invention. Cradle 208 extends only partially around container 100 circumferentially from longitudinal edge 218 on one side of container 100 to longitudinal edge 228 on the other side of container 100 between bottom 122 and shoulder 120 of container 100, and longitudinal part 110A of container 100 between bottom 122 and shoulder 120 extends laterally outward from volume 250 of cradle 208 through and along the length of elongate opening 260 and beyond longitudinal edges 218 and 228. As a result, longitudinal part 110A and is exposed and free of handle 200. This "free" and exposed longitudinal part 110A of container 100 longitudinally extending along cradle 208 between bottom 122 and shoulder 120 is specifically configured to be easily and suitably pushed by hand, such as by a thumb or two or more fingers, into volume 250 through elongate opening 260 in the direction of arrow B in FIG. 31 selectively along the length of container 100 extending between head 207 and proximal extremity 204 to deform it as represented by way of illustration and reference by the dotted line position of continuous sidewall 110 for squeezing/compressing container 100 against inner surface 242 of cradle 208 without interference from handle 20. This importantly enables continuous sidewall 110 of container 100 to be squeezed by hand selectively along its length against inner surface 242 of cradle 208 by pressing the "free" longitudinal part 110A of continuous sidewall 110 of container 100, the part of continuous sidewall 110 extending laterally outward from volume 250 through and along the length of elongate opening 260 and beyond longitudinal edges 218 and 228, for squeezing the contents of container 100 from dispensing opening 132 without interference from cradle 208 of handle 200, which is the underlying support of container 100 and against which container 100 is squeezed. Again, after container 100 is depleted of its contents, it can be replenished with or without it being removing it from cradle 208, or removed and replaced with a new one.

Turning back to FIG. 32, each of the remaining implements 290B-290F are illustrated by way of examples and can be selectively connected to distal extremity 206 of head in the same way as head 292 of implement 290A to form various configurations of personal care devices in conjunction with handle and container assembly 280. In this way, handle and container assembly 280 can be selectively and repeatedly used as desired with each implement 290.

As a matter of example, implement 290B is a standard safety razor cartridge 314 configured to hold a standard double-edged blade useful for wet shaving and that when connected to handle 200 of handle and container assembly 280 forms a personal care device in the form of a handled safety razor. Implement 290C is a standard medical razor cartridge 316 useful for wet shaving for medical purposes or personal purposes as desired and that when connected to handle 200 of handle and container assembly 280 forms a personal care device in the form of a handled medical razor for medical use or personal use if so desired. Implement 290D is a standard single-blade cartridge 318 useful for wet shaving and that when connected to handle 200 of handle and container assembly 280 forms a personal care device in the form of a handled razor. Implement 290E is an applicator pad or sponge 320 useful for applying liquid cleansers, lotions or other chosen liquid cosmetic preparation and that when connected to handle 200 of handle and container assembly 280 forms a personal care device in the form of a handled applicator. Implement 290F is a toothbrush cartridge 322 useful for brushing teeth and that when connected to handle 200 of handle and container assembly 280 forms a personal care device in the form of a handled toothbrush. Since implements 290B, 290C, and 290D are bladed tools useful for shaving, the related contents of container 100 can be the same or like those described in conjunction with personal care device 310. Since implement 290E is an applicator pad or sponge 320, the related contents of container 100 can be a liquid cleanser, lotion or other chosen liquid cosmetic preparation intended to be applied over the skin or other chosen surface by applicator pad or sponge 320. Since implement 290F is a toothbrush cartridge 322, the related contents of container 100 can be a chosen toothpaste or gel dentifrice composition intended to be used while brushing teeth with toothbrush cartridge 322. It is to be noted that implement 290B is exemplary of a multi-tool, in that head 292 is configured with an additional applicator pad or sponge 320 useful for applying a chosen shaving-related cosmetic.

Implements 290 in FIG. 32 useful with handle and container assembly 280 are shown by way of example, and other implement forms can be used to form alternate embodiments of personal care devices when connected to handle and container assembly 280 as desired. Since each implement 290 is configured to be connected releasably to distal extremity 206 of handle 200 of handle and container assembly 280, each can be selected removed and replaced with a fresh one as needed, handle 200 can be used independently of container 100 with any chosen implement, and container 100 can be replenished with chosen contents as needed or replaced with a fresh one as needed, all of which provides exemplary flexibility. In alternate embodiments, distal extremity 206 of handle 200 can be permanently attached to a chosen personal care implement.

Figure 35:
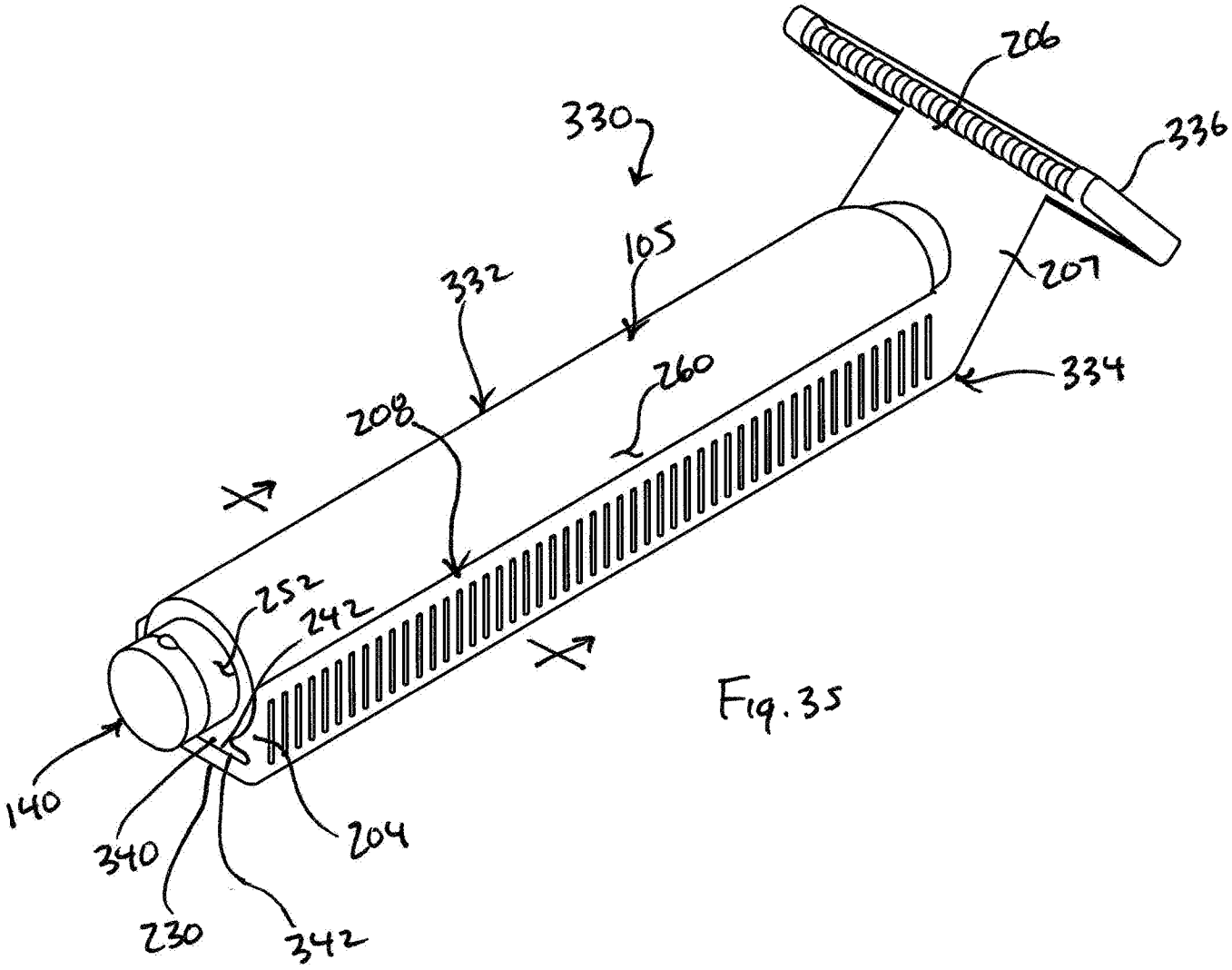
FIG. 35 is a perspective view of an embodiment of a personal care device constructed and arranged in accordance with the principle of the invention.
Figure 36:
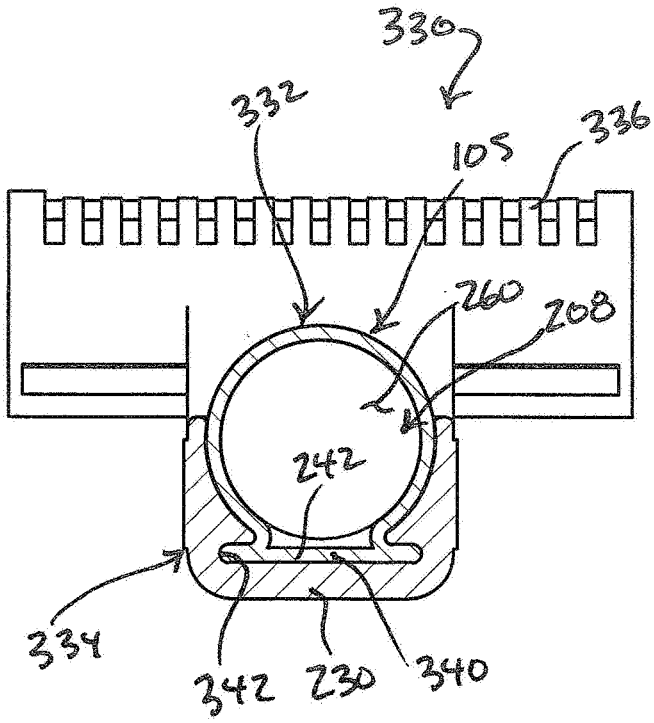
FIG. 36 is a section view taken along line 36-36 of FIG. 35.

Attention is now directed in relevant part to FIGS. 35 and 36 illustrating an exemplary embodiment of a personal care device 330 including container 332, handle 334, and personal care implement 336. Although container 332 and handle 334 have somewhat different designs than container 100 and handle 200, respectively, they are structurally common and the same reference characters are used where appropriate.

In common with container 100, container 332 shares body 105 and its various appurtenances including closure 140. Unlike container 100, container 332 is cylindrical in shape instead of oblong, and in place of ribs 134 it incorporates a single, longitudinally extending tongue denoted at 340.

In league with handle 200, handle 332 shares proximal extremity 204, distal extremity 206, head 207 defining distal extremity 206, cradle 208 extending longitudinally from head 207 to proximal extremity 204 open to cradle 208 by opening 252 and which is configured to receive and hold container 332 as described above in conjunction with handle and container assembly 280, and elongate opening 260. Unlike cradle 208 of handle 100, in place of the previously-described ribs 134 cradle 208 incorporates a single, longitudinally extending tongue-receiving groove 342, in this embodiment formed in inner surface 242 of bottom wall 230, and head 207 of handle 332 is slightly inturned to distal extremity 206 that carries an attached implement 336. Implement 36 is permanently attached to distal extremity 206 in this example, in which implement 336 and handle 332 constitute a one-piece handled implement that may be discarded once implement 336 is spent or no longer useful. In this embodiment, implement 336 is a bladed cartridge 338, whether single-bladed or multi-bladed, primarily used in the removal of unwanted body hair through the act of wet shaving. Accordingly, handle 334 and its permanently attached bladed cartridge 338 constitute a disposable, handled razor that is discarded when the one or more blades of bladed cartridge 328 become dull and thereby undesirable or ineffectual for shaving.

Tongue 340 of container 332 and groove 342 of cradle 208 serve as an alternate embodiment of a retention assembly configured to releasably and positionally retain container 232 to cradle 208 when container 232 and cradle 208 are assembled slidably. Handle 200 can be similarly configured with tongue 340 and groove 342 in place of ribs 134 and grooves 270 in an alternate embodiment. In the embodiment as shown in FIG. 36, tongue 340, a retention element, is integrally formed with continuous sidewall 110, and has an inverted, generally T-shaped configuration that extends downwardly and laterally outwardly into correspondingly-shaped groove 342, a complemental retention element. Groove 342 slidably accepts tongue 340 when container 332 is slidably inserted into cradle 208 through proximal extremity 204. Tongue 340 slidably withdraws from groove 342 when container 332 is withdrawn slidably from cradle 208 through proximal extremity 204. The complementing cross-sectional shapes of tongue 340 and groove 342 are the same along the lengths of container 332 and cradle 208.

Tongue 340 and groove 342 serve as an alternate embodiment of a retention assembly. Like each rib 134 and corresponding groove 270, tongue 340 extends longitudinally along the length of container 232, groove extends longitudinally along the length of cradle 208, and the assembled tongue 340 and groove 342 concurrently extend longitudinally along the length of cradle 208 in a direction from head 207 to proximal extremity 204. Although bladed cartridge 338 serves as the form implement 336 in personal care device 330, personal care device 330 can be configured with any desired form of personal care implement as may be desired consistent with this disclosure. As in the previously-described embodiments, container 332 can be charged with desired contents useful in conjunction with the chosen form of implement.

Figures 37, 38, 39:
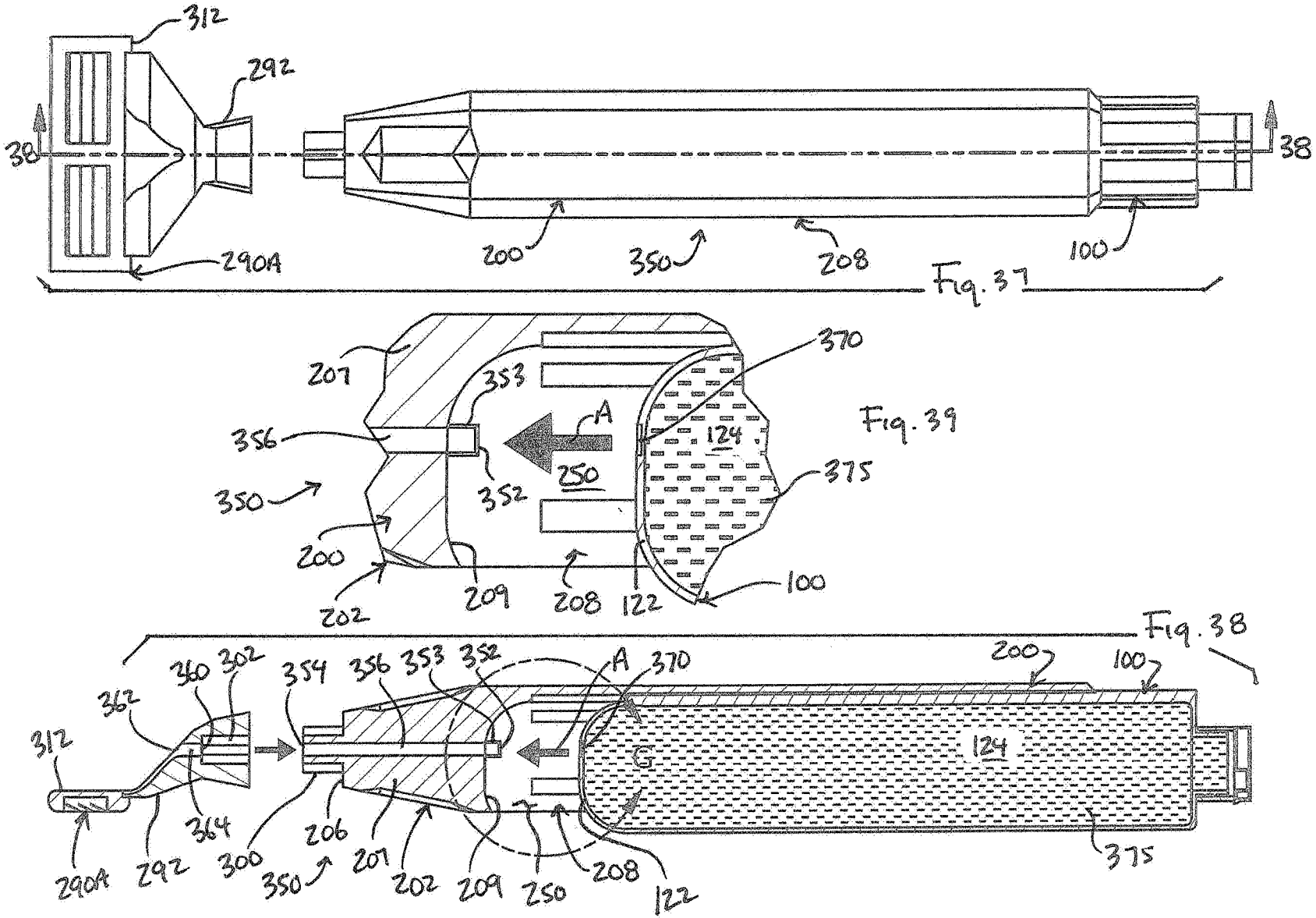
FIG. 37 is a partially exploded perspective view of another embodiment of a personal care device constructed and arranged in accordance with the principle of the invention.
FIG. 38 is a section view taken along line 38-38 of FIG. 37.
FIG. 39 is an enlarged view of a circled portion of the embodiment of FIG. 38.

Reference is now directed to FIG. 37 illustrating a partially exploded perspective view of a personal care device 350 constructed and arranged in accordance with an alternate embodiment of the invention. Device includes the previously described container 100, handle 200, and implement 290A, and the same reference characters are present where appropriate to designate the previously described structural components for orientation and reference. In FIG. 37, container 100 is shown partially inserted into cradle 208 of handle 200 and implement 290A, the previously-described multi-blade cartridge 312 illustrated by way of example, is shown detached from distal extremity 206 of handle 200.

Referring in relevant part to FIG. 38, which is a section view taken along line 38-38 of FIG. 37, and FIG. 38, which is an enlarged view of circled area G of FIG. 38, head 207 of handle 200 is configured with an inlet 352 in fluid communication with an outlet 354 by a fluid-flow channel 356 extending through head 207 from inlet 352 to outlet 354. Channel 356 longitudinally extends through head 207 from inlet 352, that is proximate to end wall 209 and open to volume 250 of cradle 208, to distal extremity 206 and beyond distal extremity 206 through the engagement element of handle 200 to outlet 354 that is open from the engagement element. In this embodiment, the engagement element of handle 200 is the previously-described radially notched pin 300, in which channel 356 extend beyond distal extremity 206 through pin 300 to outlet 354 through the outermost end of pin 300. Inlet 352 is a rigid nipple 355 extending into volume 250 of cradle 208 from end wall 209.

With continuing reference to FIG. 38, head 292 that carries implement 290A is configured with an inlet 360 in fluid communication with an outlet 362 by a fluid-flow channel 364 extending through head 292 from inlet 360 to outlet 362. Channel 364 longitudinally extends through head 292 from inlet 360 that is open to the complemental engagement element of head 292 outlet 362 that is, in turn, open to implement 290A, multi-blade cartridge 312 in this example. In this embodiment, the complemental engagement element of head 292 is the previously-described radially notched socket 300, in which inlet 360 is open to socket 300.

Figure 41:
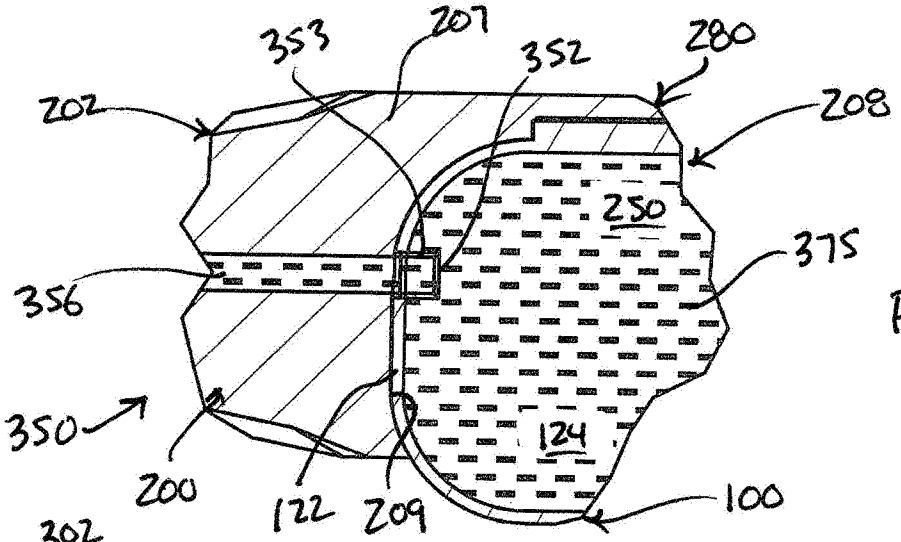
FIG. 41 is an enlarged view of a circled portion of the embodiment of FIG. 40.
Figure 40:
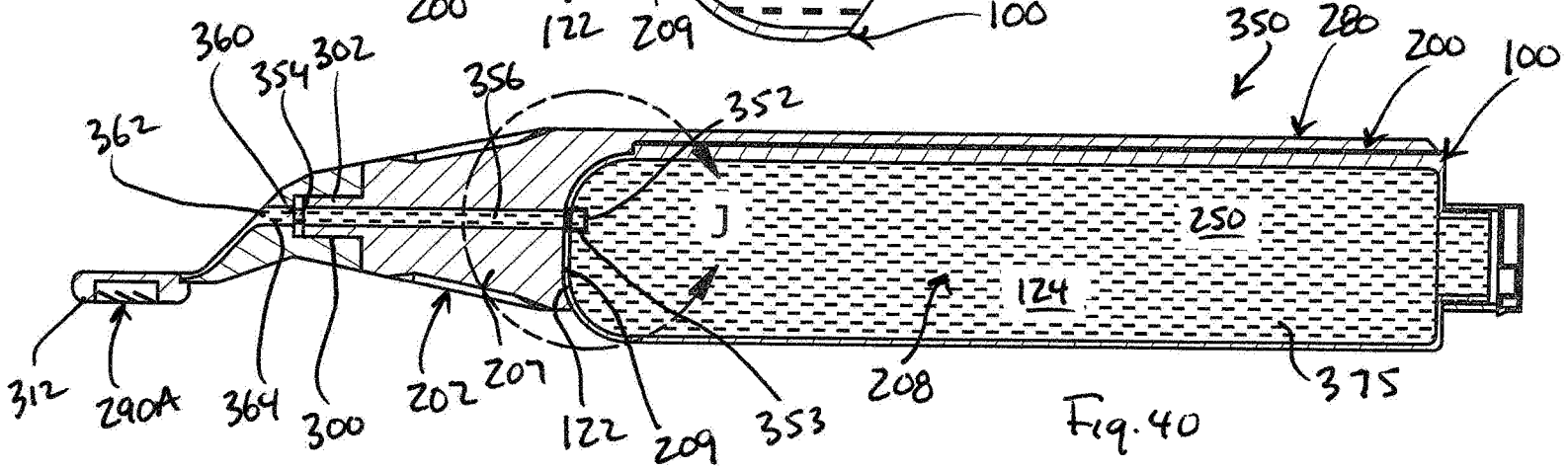
FIG. 40 is a section corresponding to FIG. 38 illustrating the personal care device as it would appear assembled.

As shown in FIGS. 38 and 39, bottom 122 of container 100 is configured with a frangible section 370. Frangible section 370 is a thinned, easily punctured area of bottom 122 that registers with nipple 353 when container 100 is partially installed in volume 250 of cradle 208. When container 100 is advanced longitudinally through volume 250 of cradle 208 in the direction of arrow A in FIGS. 38 and 39 to its installed position in FIG. 40 and FIG. 41, which is an enlarged view of circled area J of FIG. 40, to complete the assembly of handle and container assembly 280, bottom 122 is brought proximate to and in direct contact against end wall 209 and nipple 353 punches through frangible section 370 of bottom 122 into volume 124 of container 100 thereby coupling inlet 352 in fluid communication with volume 124 and its contents 375 in response. In this configuration, inlet 352 is brought in fluid communication with container 100 volume 124 and its contents 375 and outlet 354, outlet 354 is in fluid communication with inlet 360 and outlet 362 is in fluid communication with outlet 362 open to implement 290A, all of which couples container 100 volume 124 and its contents 375 in fluid communication with implement 290A, in accordance with the principle of the invention. Container 100 is squeezed as previously described to compress the contents 375 within volume 124 and thereby expel the contents 375 into channel 356 through inlet 352, through channel 356 to outlet 354 and outwardly through outlet 354 into channel 364 through inlet 360 and outwardly from channel 364 through outlet 362 an outwardly along head 292 to implement 290A. In this way, the contents 375 in volume 124 of container 100, such as a chosen shaving cream, gel, lotion, soap, or other chosen shaving-related cosmetic useful for shaving with implement 290A, are dispensed directly to implement 290A through heads 207 and 292 by squeezing container 100. The head 292 of each of implements 290B-290F in FIG. 32 can be selectively configured in the same way for coupling container 100 volume 124 and its suitable contents 375 in fluid communication with and for use in conjunction with the given implement 290.

Figures 42, 43, 44:
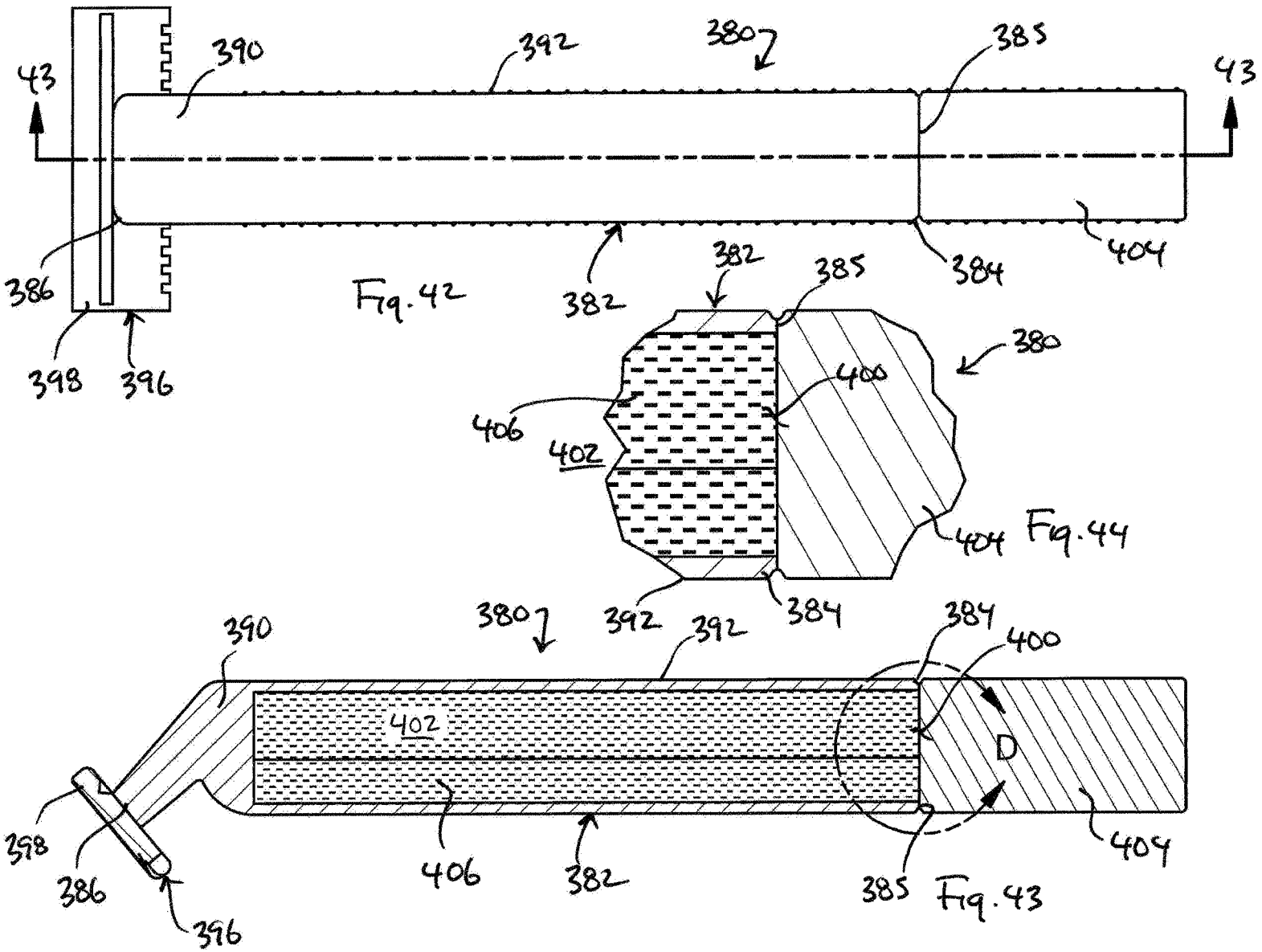
FIG. 42 is a bottom plan view of still another embodiment of personal care device constructed and arranged in accordance with the principle of the invention.
FIG. 43 is a section view taken along line 43-43 of FIG. 42.
FIG. 44 is an enlarged view of a circled portion of the embodiment of FIG. 43.

Yet another embodiment of a personal care device 380 is shown in FIGS. 42-45. Device 380 includes a body 382 having proximal extremity 384 and a distal extremity 386. Body 382 is configured with a head 390 and a hollow handle 392. Head 390 extends outwardly to and defines distal extremity 386 that is formed with an attached personal care implement 396. Handle 392 longitudinally extends from head 390 to proximal extremity 384 including continuous edge 385 defining opening 400 that is open to volume 402 defined by hollow handle 392 and normally closed by a breakaway closure 404 connected frangibly to edge 385 of proximal extremity 384. Volume 402 extends longitudinally through handle 392 from head 390 to opening 400 at proximal extremity 384 and is charged with a personal care composition 406 configured to be used in conjunction with implement 396, as shown in FIG. 43. Closure 396 is a plug frangibly connected to edge 385 of proximal extremity 384 to normally close opening 400 thereby confining/encapsulating personal care composition 406 in volume 402 as shown in FIG. 43 and FIG. 44, which is an enlarged view of circled area D of FIG. 43. 38. Handle 392 is elongate and longitudinally straight from head 390 to proximal extremity 384 and is sufficiently long, approximately three to five inches in length in this example, to enable it to be easily taken up by hand and used to wield implement 396 carried by distal extremity 386. Body 382 and closure 404 are preferably formed of plastic and are each preferably integrally formed, such as my molding or machining. Closure 404 is frangibly attached to edge 385 proximal extremity 384 adhesively, by heat bonding, or the like that suitably frangibly connects closure 404 to edge 385 of proximal extremity 384 and enables it to be broken away or otherwise snapped off from edge 385 of proximal extremity 384 by hand by the application of force.

Head 390 is slightly inturned to distal extremity 386 that in this example is permanently attached to implement 396, in which implement 396 and body 382 constitute a one-piece, disposable, handled implement that is designed to be discarded once implement 396 is spent or no longer useful. In this embodiment, implement 396 is a bladed cartridge 398, whether single-bladed or multi-bladed, primarily used in the removal of unwanted body hair through the act of wet shaving. Accordingly, body 382 and its permanently attached bladed cartridge 398 constitute a disposable, handled razor that is discarded after a single use or when the one or more blades of bladed cartridge 398 become dull and thereby undesirable or ineffectual for shaving.

Figure 45:
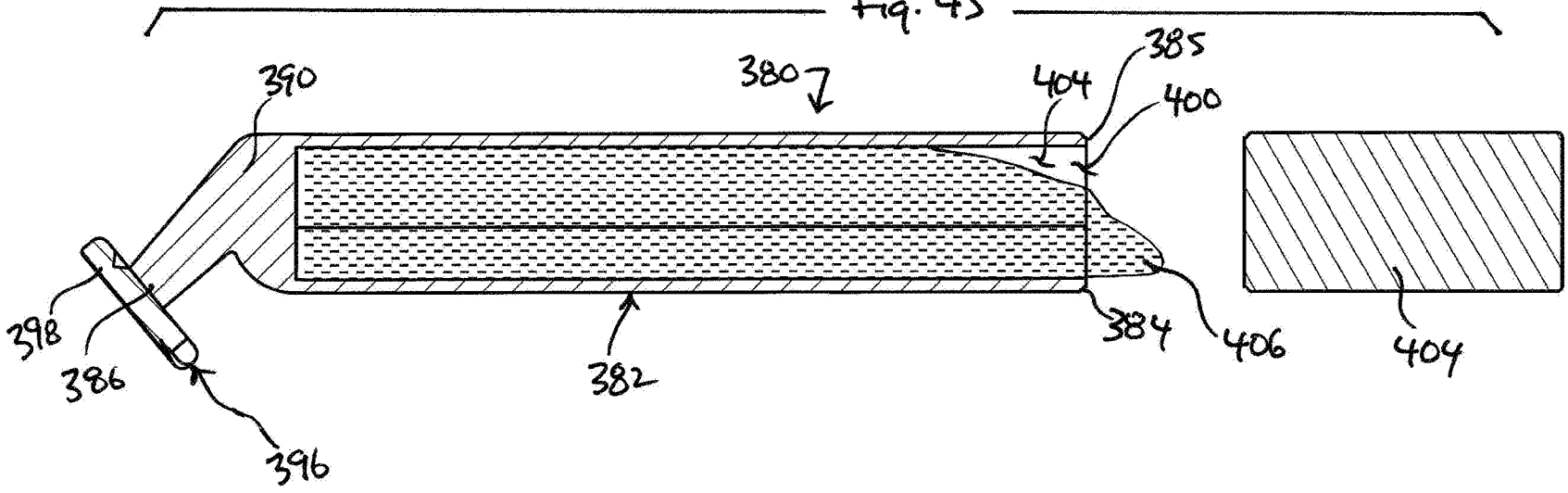
FIG. 45 is a section view corresponding to FIG. 43 illustrating a break-away closure as it would appear broken away from a handle of the personal care device.

Since personal care device 280 is exemplary of a handled razor, the personal care composition 406 in volume 402 are shaving-associated contents that relate to the use of implement 396 for shaving, such as a pre-shaving cosmetic, a shaving cosmetic, or an aftershave cosmetic. To release personal care composition 406 from volume 402 for use before, during, or after shaving, the user need only forcibly break closure 404 away from edge 385 from proximal extremity 384 by hand as shown in FIG. 45, which opens opening 400 and thereby releases personal care composition 406 from volume 402 through the now open opening 400.

Although bladed cartridge 398 serves as the form implement 396 in personal care device 380, personal care device 380 can be configured with any desired form of personal care implement as may be desired consistent with this disclosure, including any of those shown and described in conjunction with FIG. 32. As in the previously-described embodiments, volume 402 can be charged with desired contents useful in conjunction with the chosen form of implement.

Figure 46:
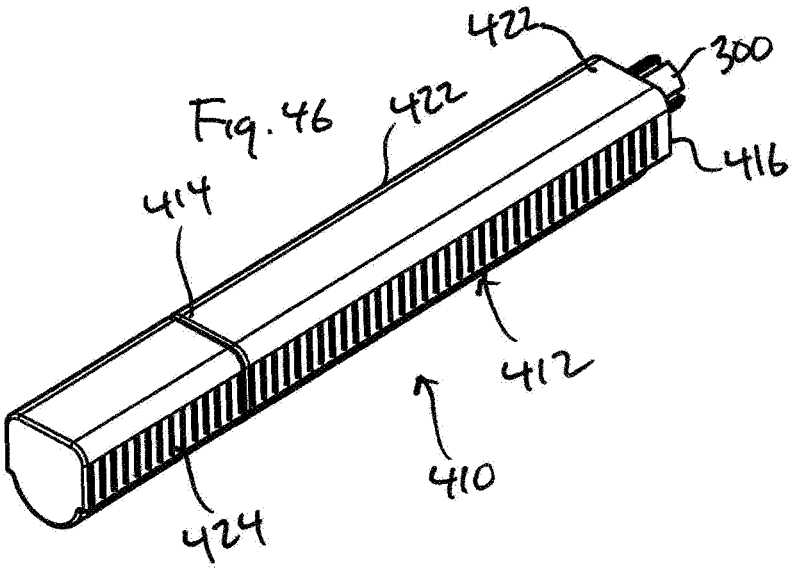
FIG. 46 is a perspective view of a substance dispensing handle assembly constructed and arranged in accordance with the principle of the invention.

A substance dispensing handle assembly 410 including a body 412 having proximal extremity 414 and a distal extremity 416 is shown in FIG. 46. In this embodiment, and like the previously-described body 382 of personal care device 380, body 412 is configured with a head 420 and a hollow handle 422. Head 390 defines distal extremity 416. In common with personal care device 380, handle 422 longitudinally extends from head 400 to proximal extremity 414 defining an opening (not show) that is open to a volume (not shown) defined by handle 422 and normally closed by a breakaway closure 424 connected frangibly to proximal extremity 414, which volume extends longitudinally through handle 420 from head 420 to the handle 422 opening at proximal extremity 414 and is charged with a personal care composition (not shown) configured to be used in conjunction with an attached implement. As with personal care device 380, closure 424 is a plug frangibly connected to proximal extremity 384 to normally close the handle 422 opening to confine the personal care composition in the handle 422 volume. The personal care composition is released from the handle 422 volume through the handle 422 opening simply by forcibly breaking closure 424 away from proximal extremity 414.

Distal extremity 416 is configured with the engagement element of the previously-described handle 200, namely, radially notched pin 300, which forms part of the engagement assembly used to selectively and releasably connect the corresponding complemental engagement element, the previously-described radially notched socket 302, of each head 292 of each implement 290. Accordingly, each previously-described implement 290, or other chosen personal care implement configured with the complemental engagement element of the engagement assembly, can be selectively and connected releasably to distal extremity 416 of substance dispensing handle assembly 410 to form the corresponding personal care device as previously described. The personal care composition contents of handle and container assembly 410 are chosen to relate to the particular implement chosen as described throughout this disclosure.

The present invention is described above with reference to illustrative embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof. Having fully described the invention in such clear and concise terms as to enable those skilled in the art to understand and practice the same, the invention claimed is:

The invention claimed is:

1. A handle and container assembly, comprising:

a handle comprising a head, a cradle longitudinally extending from the head to a proximal extremity open to the cradle and an elongate opening open to the cradle and extending longitudinally between the head and the proximal extremity and defined by mutually respective longitudinal edges; and a container longitudinally extending through the cradle from proximate to the head to a dispensing opening proximate to the proximal extremity and normally closed by a closure, the container is deformable and a longitudinal part of the container extends laterally outward from the cradle through the elongate opening beyond the longitudinal edges.

2. The handle and container assembly according to claim 1, wherein the container is resiliently deformable enabling the container to spring back, rebound, or otherwise return to an original form, an un-squeezed or un-collapsed form, after being deformed or collapsed by being squeezed, the elongate opening has a length from the head to the proximal extremity, and the longitudinally part of the container extends longitudinally through the length of the elongate opening from the head to the proximal extremity.

3. The handle and container assembly according to claim 1, wherein:

the closure is movable from a first position, wherein the dispensing opening normally closed, to a second position, wherein the dispensing opening is open; and the closure extends longitudinally outwardly from the proximal extremity to enable movement of the closure between the first position and the second position without interference from the handle.

4. The handle and container assembly according to claim 1, wherein the container is received slidably in the cradle through the proximal extremity.

5. The handle and container assembly according to claim 4, further comprising a retention assembly releasably retaining the container to the cradle comprising retention elements of the container received slidably by corresponding complemental retention elements of the cradle, wherein each said retention element comprises one of a rib and a groove and each said complement retention element comprises the other of the rib and the groove.

6. The handle and container assembly according to claim 5, wherein the ribs and the grooves concurrently extend longitudinally in a direction from the head to the proximal extremity.

7. The handle and container assembly according to claim 1, wherein an outer end of the container opposite to the dispensing opening is juxtaposed with the head, and the longitudinal part extends between the outer end of the container and the proximal extremity.

8. The handle and container assembly according to claim 7, wherein the outer end of the container is in direct contact against the head.

9. The handle and container assembly according to claim 1, further comprising a personal care implement carried by the head.

10. The handle and container assembly according to claim 9, wherein the personal care implement is connected releasably to the head.

11. The handle and container assembly according to claim 1, wherein the head includes an inlet in fluid communication with the container and an outlet in fluid communication with the inlet.

12. The handle and container assembly according to claim 11, wherein the inlet comprises a nipple extending into the container from the head.

13. The handle and container assembly according to claim 11, further comprising:

a personal care implement carried by the head; and the outlet is open to the personal care implement.

14. The handle and container assembly according to claim 13, wherein the personal care implement is connected releasably to the head by an engagement element of the head connected releasably to a complemental engagement element of the personal care implement, and the outlet is open to the personal care implement from the engagement element.

15. A handle and container assembly, comprising:

a handle comprising a head, a cradle longitudinally extending from the head to a proximal extremity open to the cradle and an elongate opening open to the cradle and extending longitudinally between the head and the proximal extremity and defined by mutually respective longitudinal edges;

a container longitudinally extending through the cradle, the container is deformable and a longitudinal part of the container extends laterally outward from the cradle through the elongate opening beyond the longitudinal edges; and the head includes an inlet in fluid communication with the container and an outlet in fluid communication with the inlet.

16. The handle and container assembly according to claim 15, wherein the container is resiliently deformable enabling the container to spring back, rebound, or otherwise return to an original form, an un-squeezed or un-collapsed form, after being deformed or collapsed by being squeezed.

17. The handle and container assembly according to claim 15, wherein the inlet comprises a nipple extending into the container from the head.

18. The handle and container assembly according to claim 17, wherein the container includes an outer end in direct contact against the head, the nipple extends into the container through the outer end, and the longitudinal part extends between the outer end of the container and the proximal extremity.

19. The handle and container assembly according to claim 15, wherein the container additionally includes a dispensing opening proximate to the proximal extremity and normally closed by a closure.

20. The handle and container assembly according to claim 15, wherein the container is received slidably in the cradle through the proximal extremity.

21. The handle and container assembly according to claim 20, further comprising a retention assembly releasably retaining the container to the cradle comprising retention elements of the container received slidably by corresponding complemental retention elements of the cradle, wherein each said retention element comprises one of a rib and a groove and each said complement retention element comprises the other of the rib and the groove.

22. The handle and container assembly according to claim 21, wherein the ribs and the grooves concurrently extend longitudinally in a direction from the head to the proximal extremity.

23. The handle and container assembly according to claim 15, further comprising:

a personal care implement carried by the head; and the outlet is open to the personal care implement.

24. The handle and container assembly according to claim 23, wherein the personal care implement is connected releasably to the head by an engagement element of the head connected releasably to a complemental engagement element of the personal care implement, and the outlet is open to the personal care implement from the engagement element.

25. A personal care device, comprising:

a handle comprising a head supporting a personal care implement, a cradle extending longitudinally from the head to the proximal extremity open to the cradle, and an elongate opening open to the cradle and extending longitudinally between the head and the proximal extremity and defined by mutually respective longitudinal edges; and a container in fluid communication with the personal care implement and longitudinally extending through the cradle, the container is deformable and a longitudinal part of the container extends laterally outward from the cradle through the elongate opening beyond the longitudinal edges.

26. The person care device according to claim 25, wherein the container is resiliently deformable enabling the container to spring back, rebound, or otherwise return to an original form, an un-squeezed or un-collapsed form, after being deformed or collapsed by being squeezed.

27. The personal care device according to claim 25, wherein the container additionally includes a dispensing opening proximate to the proximal extremity and normally closed by a closure.

28. The personal care device according to claim 25, wherein the container is received slidably in the cradle through the proximal extremity.

* * * * *